US007780164B2

(12) United States Patent
Hirai

(10) Patent No.: US 7,780,164 B2
(45) Date of Patent: Aug. 24, 2010

(54) SHEET PROCESSING APPARATUS AND IMAGE FORMING APPARATUS

(75) Inventor: Katsuaki Hirai, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/181,649

(22) Filed: Jul. 29, 2008

(65) Prior Publication Data

US 2009/0008858 A1 Jan. 8, 2009

Related U.S. Application Data

(63) Continuation of application No. 11/182,780, filed on Jul. 18, 2005, now Pat. No. 7,426,367.

(30) Foreign Application Priority Data

Jul. 21, 2004 (JP) ..... 2004-212820
Jul. 21, 2004 (JP) ..... 2004-212821
Jun. 23, 2005 (JP) ..... 2005-183020

(51) Int. Cl.
*B65H 39/10* (2006.01)

(52) U.S. Cl. ..... 271/288; 271/298

(58) Field of Classification Search ..... 271/288, 271/298; 270/58.07, 58.08, 58.09; 399/407, 399/408, 410
See application file for complete search history.

(56) References Cited

U.S. PATENT DOCUMENTS

| | | | | |
|---|---|---|---|---|
| 4,864,365 | A | 9/1989 | Ito | 399/28 |
| 5,021,837 | A | 6/1991 | Uto | 355/322 |
| 5,406,358 | A | 4/1995 | Kimura et al. | 355/271 |
| 5,465,949 | A | 11/1995 | Yamada et al. | 271/110 |
| 5,573,233 | A | 11/1996 | Hirai et al. | 270/58.08 |
| 5,671,917 | A | 9/1997 | Choho et al. | 271/111 |
| 5,871,208 | A | 2/1999 | Hirai et al. | 271/3.01 |
| 5,897,250 | A | 4/1999 | Hirai et al. | 399/404 |
| 6,217,016 | B1 | 4/2001 | Honmochi et al. | 270/37 |
| 6,264,194 | B1 | 7/2001 | Hayashi et al. | 271/220 |
| 6,283,470 | B1 | 9/2001 | Hirai | 271/189 |
| 6,474,633 | B1 | 11/2002 | Hirai | 270/58.09 |
| 6,785,507 | B2 | 8/2004 | Asai et al. | 399/391 |
| 6,860,478 | B2 | 3/2005 | Hirai | 270/58.07 |
| 2003/0202829 | A1 | 10/2003 | Sato et al. | 399/382 |
| 2004/0136733 | A1 | 7/2004 | Kretschmann et al. | 399/16 |
| 2005/0082734 | A1 | 4/2005 | Goto et al. | 271/1 |
| 2005/0082735 | A1 | 4/2005 | Nakamura et al. | 271/1 |
| 2005/0084308 | A1 | 4/2005 | Nakamura et al. | 399/407 |
| 2005/0220521 | A1 | 10/2005 | Kuwata et al. | 399/407 |
| 2006/0018695 | A1 | 1/2006 | Hirai | 399/407 |

FOREIGN PATENT DOCUMENTS

| | | |
|---|---|---|
| JP | 2-144370 | 6/1990 |
| JP | 10-194582 | 7/1998 |
| JP | 11-322170 | 11/1999 |

*Primary Examiner*—David H Bollinger
(74) *Attorney, Agent, or Firm*—Fitzpatrick, Cella, Harper & Scinto

(57) ABSTRACT

A sheet processing apparatus comprises that a plurality of sheet processing portions that perform a sheet process on a sheet; and a plurality of conveying paths which transport the sheet to connect to the plurality of sheet processing portions, respectively, wherein while one of the plurality of sheet processing portions executes the sheet process on a preceding sheet or a preceding sheet bundle, a subsequent sheet is conveyed to the conveying path connecting to the other one of the plurality of sheet processing portions and held on standby on the conveying path connecting to the other sheet processing portion.

13 Claims, 26 Drawing Sheets

SHEET PROCESSING APPARATUS AND IMAGE FORMING APPARATUS

This application is a continuation of U.S. patent application Ser. No. 11/182,780, filed Jul. 18, 2005, now U.S. Pat. No. 7,426,367.

BACKGROUND OF THE INVENTION

1. Field of the Invention

The present invention relates to a sheet processing apparatus and an image forming apparatus. More specifically, the present invention is suitably applied to a sheet processing apparatus that includes a plurality of sheet processing portions, and to an image forming apparatus, e.g., a copier or a laser beam printer (LBP), to which the sheet processing apparatus is connected.

2. Description of the Related Art

There has been conventionally proposed a sheet processing apparatus (hereinafter, "finisher") included in a copier or the other image forming apparatus, and performing processes including such as a process for forming an image on a sheet such as a printed sheet by the image forming apparatus and a process for stitching sheets.

As such a finisher, there is known a finisher configured by a combination of first processing portion (hereinafter, "processing tray") that registers and bundles a predetermined number of sheets and that wire-stitches a bundle of sheets (hereinafter, "sheet bundle") if it is necessary to do so, and stacking means (hereinafter, "stack tray") that receives and stores every registered sheet bundle or wire-stitched sheet bundle. Many techniques therefor including one disclosed in, for example, Japanese Patent Application Laid-Open No. 2-144370 have been already proposed.

The finisher often includes not only a conventional end stitching function of stitching the sheet bundle on its end but also a saddle stitching function of stitching the sheet bundle generally at its center, which function enables simple binding. Many techniques for the finisher of this type including one disclosed in, for example, Japanese Patent Application Laid-Open No. 11-322170 have been already proposed.

Further, as for the finisher that stacks a plurality of sheets conveyed from the image forming apparatus while a stitching process is being performed on the sheet bundle on the processing tray, and that discharges and registers the sheets to the processing tray after the stitching process, many techniques including one disclosed in, for example, Japanese Patent Application Laid-Open No. 10-194582 have been proposed.

The finisher includes, around the processing tray, a conveying path for conveying a sheet to the processing tray, a standby path (hereinafter, "buffer path") for temporarily holding the sheet on standby, a buffer roller that conveys the sheet on the buffer path, a pair of sheet discharge rollers that discharge the sheet to the processing tray, a jogger that registers the sheets in a direction orthogonal to a sheet discharge direction while being moved in a front direction and a depth direction, a stapler that wire-stitches the sheet bundle, a pair of sheet bundle discharge rollers for conveying the sheet bundle on the processing tray to the stack tray, and the like.

Normally, the sheets discharged from an image forming apparatus main body are passed through the conveying path provided in the finisher, discharged to the processing tray by the sheet discharge roller pair, and sequentially stacked on the processing tray. The sheets discharged to and stacked on the processing tray are registered in the discharge direction whenever every sheet is discharged and then registered by the jogger in the direction orthogonal to the discharge direction.

If a predetermined number of sheets are registered and stacked on the processing tray to form a sheet bundle, the sheet bundle is wire-stitched by the stapler. The wire-stitched sheet bundle is discharged to the stack tray by the sheet bundle discharge roller pair.

Meanwhile, subsequent sheets cannot be conveyed to the processing tray until such a sheet bundle stitching process is executed, the sheets are discharged to the stack tray, and the processing tray is evacuated. Due to this, the sheets conveyed from the image forming apparatus main body during this period are temporarily held on standby in front of the processing tray. This standby process, which is performed by the buffer roller on the buffer path, will be referred to as "buffering" hereinafter. When the processing tray is evacuated, a sheet conveyed next from the image forming apparatus main body is superimposed on the buffered sheets in the buffer path and the resultant sheets are conveyed toward the processing tray.

The finisher that treats sheets having a plurality of sheet sizes has, however, the following disadvantages. Since it is necessary to provide a plurality of buffer paths connecting to the respective sheet sizes, a path configuration and a conveyance control are complicated. This not only makes the apparatus large in size but also deteriorates sheet process reliability.

SUMMARY OF THE INVENTION

The present invention has been achieved in view of the above-mentioned situations. It is, therefore, an object of the present invention to provide at least a sheet processing apparatus and an image forming apparatus capable of executing buffering performed to ensure appropriate execution of sheet process without need to additionally provide path configurations according to sheet sizes.

To achieve the object, according to a first aspect of the invention, there is provided a sheet processing apparatus comprising:

a plurality of sheet processing portions that perform a sheet process on a sheet; and a plurality of conveying paths which transport the sheet to connect to the plurality of sheet processing portions, respectively, wherein while one of the plurality of sheet processing portions executes the sheet process on a preceding sheet or a preceding sheet bundle, a subsequent sheet is conveyed to the conveying path connecting to the other one of the plurality of sheet processing portions and held on standby on the conveying path connecting to the other sheet processing portion.

According to a second aspect of the invention, there is provided an image forming apparatus comprising:

an image forming apparatus main body which forms images on a sheet; and a sheet processing apparatus that performs a sheet process on the sheet imaged by the image forming apparatus main body, wherein the sheet processing apparatus comprises:

a plurality of sheet processing portions that perform the sheet process on the sheet; and a plurality of conveying paths which convey the sheet to connect to the plurality of sheet processing portions, respectively, and wherein while one of the plurality of sheet processing portions executes the sheet process on a preceding sheet or a preceding sheet bundle, a subsequent sheet is conveyed to the conveying path connecting to the other one of the plurality of sheet processing portions and held on standby on the conveying path connecting to the other sheet processing portions.

According to a third aspect of the invention, there is provided an image forming apparatus comprising:

an image forming apparatus main body which forms images on a sheet;

a plurality of sheet processing portions that perform a sheet process on the imaged sheet;

a plurality of conveying paths which convey the sheet to connect to the plurality of sheet processing portions, respectively; and a controller which controls such that, while one of the plurality of sheet processing portions executes the sheet process on a preceding sheet or a preceding sheet bundle, a subsequent sheet is conveyed to the conveying path connecting to the other one of the plurality of sheet processing portions and held on standby on the conveying path connecting to the other sheet processing portion, and that controls at least one of an imaging order, imaging positions, and inverted transport with respect to the subsequent sheet and a next sheet to the subsequent sheet.

According to the present invention, while one of the plurality of sheet processing portions executes the sheet process on the preceding sheet, the subsequent sheet is conveyed to the conveying path connecting to the other one of the sheet processing portion. The conveying path connecting to the other sheet processing portion is an existing conveying path and, quite naturally, longer than the sheets. It, therefore, suffices to buffer the sheet on the conveying path connecting to the other sheet processing portion. Due to this, it is unnecessary to newly provide a buffer path per se according to the sheet size.

The controller controls the subsequent sheet to be superimposed on the sheet next to the subsequent sheet on the conveying path connecting to the one sheet processing portion and to be conveyed to the one sheet processing portion. The controller also controls at least one of the imaging order, the imaging positions, and the inverted conveyance with respect to the subsequent sheet and the sheet next to the subsequent sheet.

According to the present invention, the sheet can be buffered without need to add a complicated path configuration to the sheet processing apparatus, whereby the apparatus can be made compact. Since the path configuration is not complicated, the reliability of the sheet process can be improved. It is also possible to prevent the image-formed surfaces from becoming inconsistent on the sheet processing portion and to prevent an incorrect page order.

BRIEF DESCRIPTION OF THE DRAWINGS

The invention, together with further advantages thereof, may best be understood by reference to the following description taken in conjunction with the accompanying drawings in which.

DESCRIPTION OF THE PREFERRED EMBODIMENTS

Figure 1:
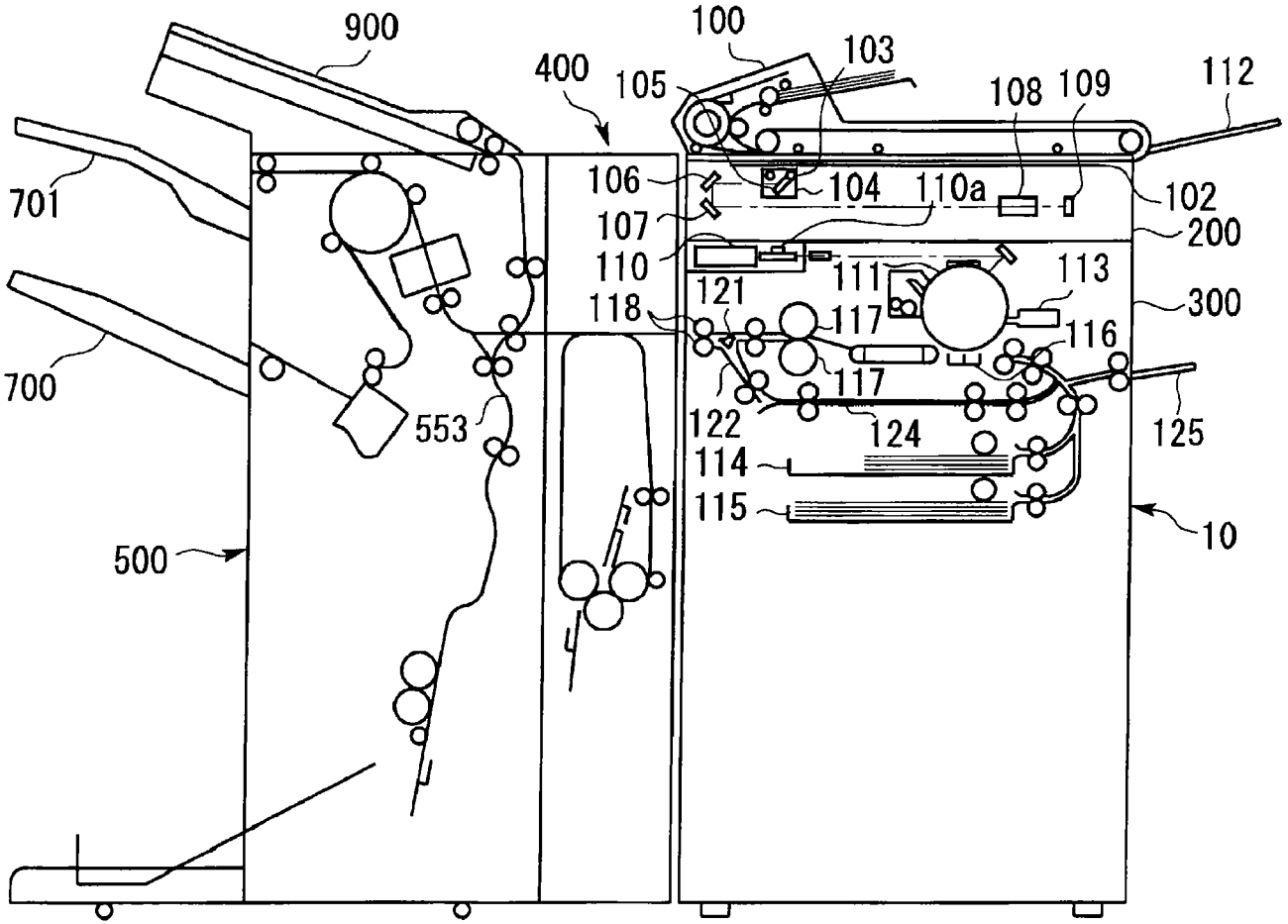
FIG. 1 is a schematic sectional view that shows an overall configuration of an image forming apparatus.

Embodiments of the present invention will be described hereinafter with reference to the drawings. In all the drawings for the embodiments, identical or corresponding constituent elements are denoted by the same reference numerals, respectively.

First Embodiment (Overall Configuration)

FIG. 1 is a longitudinal sectional view that shows an overall configuration of principal constituent elements of an image forming apparatus according to the present invention.

As shown in FIG. 1, the image forming apparatus having an image forming apparatus main body 10, a folding device 400, and a finisher 500. The image forming apparatus main body 10 is an image forming unit that forms an image on a sheet. The folding device 400 is a device that receives and conveys the sheet conveyed from the image forming apparatus main body 10, and folds the sheet if necessary.

The image forming apparatus main body 10 includes an image reader 200 that reads an image on an original and a printer 300. A document conveying apparatus 100 is mounted on this image reader 200. The document conveying apparatus 100 feeds originals set on an original tray, with each original side turned upward, sequentially from a leading page one by one in a left direction of FIG. 1, conveys the originals thus fed from left to right on a platen glass 102 through a bent path and a reading position, and then discharges the originals to an external sheet discharge tray 112.

When each of the originals is passed through the reading position on the platen glass 102, the image on the original is read by a scanner unit 104 held at a position corresponding to the reading position.

A reading method therefor is a method normally referred to as original reading method. Namely, when the original is passed through the reading position, a read target side of the original is irradiated with a light from a lamp 103 of the scanner unit 104. A reflected light from the original is introduced to a lens 108 through mirrors 105, 106, and 107. The light transmitted by the lens 108 creates an image on an imaging surface of an image sensor 109.

By thus conveying the original so as to pass the original through the reading position from left to right, an original read scan is performed with a direction orthogonal to an original transport direction set as a main scan direction, and the transport direction set as a sub-scan direction.

That is, when the original is passed through the reading position, the original is conveyed to the sub-scan direction while the image sensor 109 reads the original image on every line in the main scan direction. The entire original image is thereby read, the optically read image is converted into image data, and the image data is output by the image sensor 109. The image data output from the image sensor 109 is subjected to a predetermined processing in an image signal controller 202 (refer to FIG. 2) described later and then input to an exposure controller 110 of the printer 300 as a video signal.

The exposure controller 110 of the printer 300 modulates a laser beam based on the input video signal and outputs the modulated laser beam. This laser beam is irradiated onto a photosensitive drum 111 while being scanned by a polygon mirror 110*a*. An electrostatic latent image according to the scanned laser beam is formed on the photosensitive drum 111. The exposure controller 110 outputs the laser beam so as to form a correct image (an image which is not a mirror image) during fixed reading of the original to be described later.

The electrostatic latent image on this photosensitive drum 111 is visualized into a developed image by a developer supplied from a development unit 113. At timing synchronized with start of irradiation of the laser beam, a sheet is fed from one of cassettes 114 and 115, a manual sheet feeder 125 or a sheet re-feeding path 124. This sheet is conveyed between the photosensitive drum 111 and a transfer unit 116. The developed image formed on the photosensitive drum 111 is transferred onto the fed sheet by the transfer unit 116.

The sheet onto which the developed image is transferred is conveyed to a fixing unit 117, and the fixing unit 117 fixes the developed image on the sheet, by thermally pressing the sheet. The sheet passed through the fixing unit 117 is discharged from the printer 300 through a flapper 121 and discharge rollers 118 to an outside of the printer 300 (the folding device 400) while an image formed side thereof is turned upward (the sheet is in a face-up state).

If the sheet is to be discharged while the image formed side thereof is turned downward (the sheet is in a face-down state), then the sheet passed through the fixing unit 117 is temporarily introduced onto an inversion path 12 by switching over the flapper 121, switched back (fed in a backward direction) after a trailing end of the sheet is passed through the flapper 121, and discharged from the printer 300 by the discharge rollers 118. This sheet discharge will be referred to as "inversion sheet discharge" hereinafter. This inversion sheet discharge is executed when image formation is performed on sheets sequentially from a first page so that the image formed side of each sheet is turned upward, based on the image data read by the document conveying apparatus 100 or that output from a computer. The sheets after the inversion sheet discharge is executed are stacked in a correct page order by turning the image formed side of each sheet downward.

If the image formation is performed on both sides of each sheet, the sheet having one side already an image formed is introduced to the inversion path 122 by switching over the flapper 121 and then conveyed to the sheet re-feeding path 124. By controlling the sheet introduced to the sheet re-feeding path 124 to be fed again between the photosensitive drum 111 and the transfer unit 116 at the above-mentioned timing, an image is also formed on the other side of the sheet on which no image is formed.

The sheet discharged from the printer 300 is passed through the folding device 400 and conveyed to the finisher 500. This finisher 500 includes an inserter 900 that feeds a special sheet such as a cover or an interleaving paper to be inserted into the sheet. The finisher 500 performs processes such as book binding, stitching, and punching.

(System Block Diagram)

Figure 2:
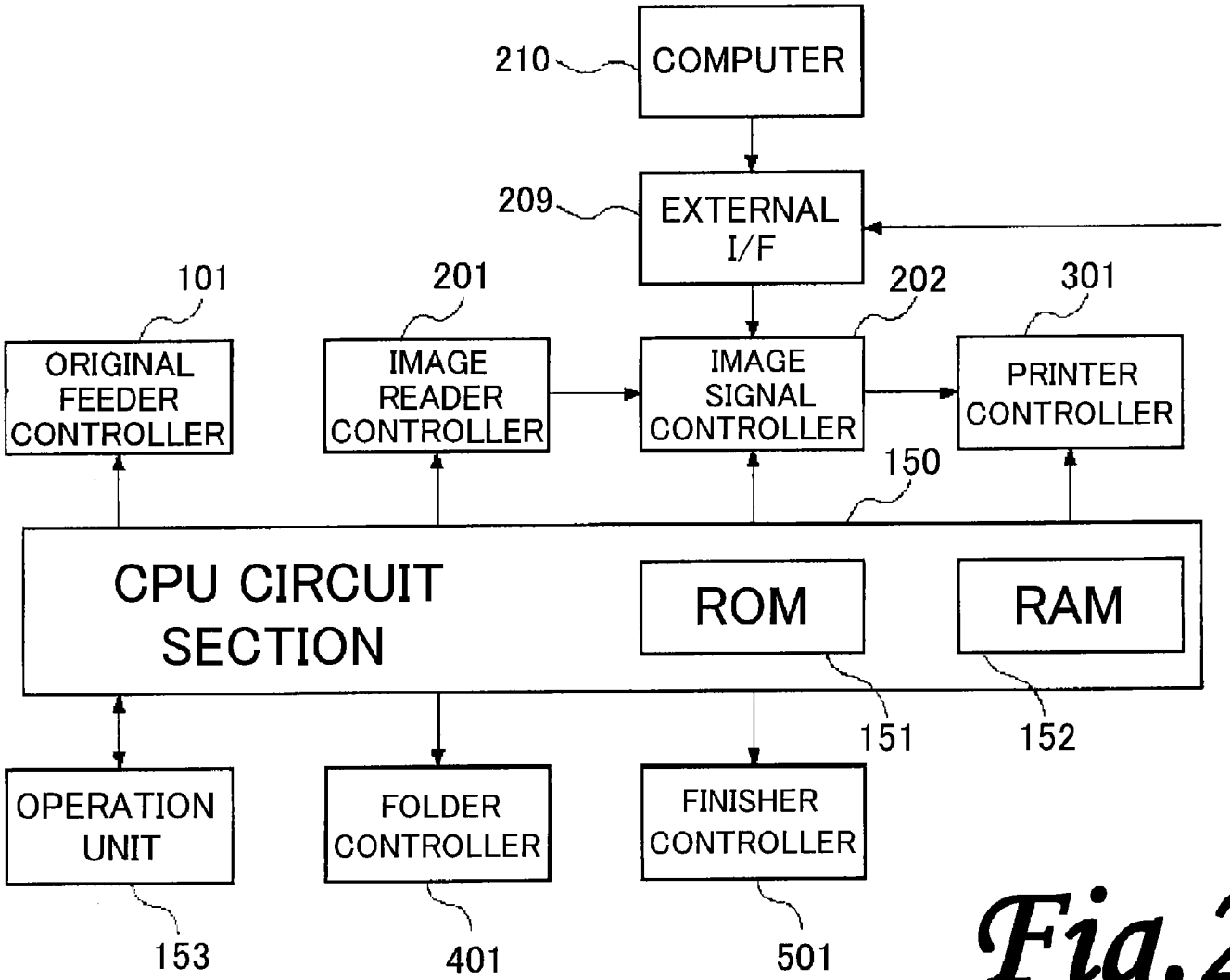
FIG. 2 is a block diagram that shows a configuration of a controller that controls entirety of the image forming apparatus.

A configuration of a controller that controls entirety of the image forming apparatus according to the first embodiment will be described. FIG. 2 shows the configuration of the controller that controls entirety of the image forming apparatus shown in FIG. 1.

As shown in FIG. 2, the controller includes a central processing unit (CPU) circuit section 150 of the image forming apparatus. The CPU circuit section 150 includes a CPU (not shown), a read only memory (ROM) 151, and a random access memory (RAM) 152. Based on a control program stored in the ROM 151, an document conveying apparatus controller 101, an operation unit 153, an image reader controller 201, an image signal controller 202, an external interface (I/F) 209, a printer controller 301, a folding device controller 401, and a finisher controller 501 are collectively controlled. The RAM 152 is used to temporarily store control data and to act as an operating area for a computation processing involving the control.

The document conveying apparatus controller 101 controls the document conveying apparatus 100 (refer to FIG. 1) to be driven based on a command from the CPU circuit section 150. The image reader controller 201 controls the scanner unit 104, the image sensor 109 or the like (refer to FIG. 1) to be driven, thereby transferring an analog image signal output from the image sensor 109 to the image signal controller 202.

The image signal controller 202 converts the analog image signal from the image sensor 109 into a digital signal, subjects the digital signal to various processes to convert the digital signal into a video signal, and outputs the video signal to the printer controller 301. In addition, the image signal controller 202 subjects a digital image signal input from a computer 210 through the external I/F 209 to various processes to convert the digital image signal into a video signal, and outputs the video signal to the printer controller 301. A processing operation performed by this image signal controller 202 is controlled by the CPU circuit unit 150. The printer controller 301 drives the exposure controller 110 (refer to FIG. 1) based on the input video signal.

The operation unit 153 (refer to FIG. 2) includes a plurality of keys for setting various functions related to image formation, a display unit for displaying information indicating setting states, and the like. The operation unit 153 outputs a key signal corresponding to an operation on each key to the CPU circuit section 150 and displays corresponding information on the display unit based on a signal from the CPU circuit section 150.

The finisher controller 501 (refer to FIG. 2), which is mounted in the finisher 500, controls entirety of the finisher 500 to be driven by exchanging information with the CPU circuit section 150. The contents of the control will be described later. In this first embodiment, it is assumed that the finisher controller 501 that controls the finisher 500 to be driven is provided in the finisher 500 independently of the CPU circuit section 150 that constitutes the controller on an image forming apparatus main body 10 side. Alternatively, the finisher controller 501 may be provided on the image forming apparatus main body 10 side or incorporated into the CPU circuit section 150.

(Folding Device)

Figure 3:
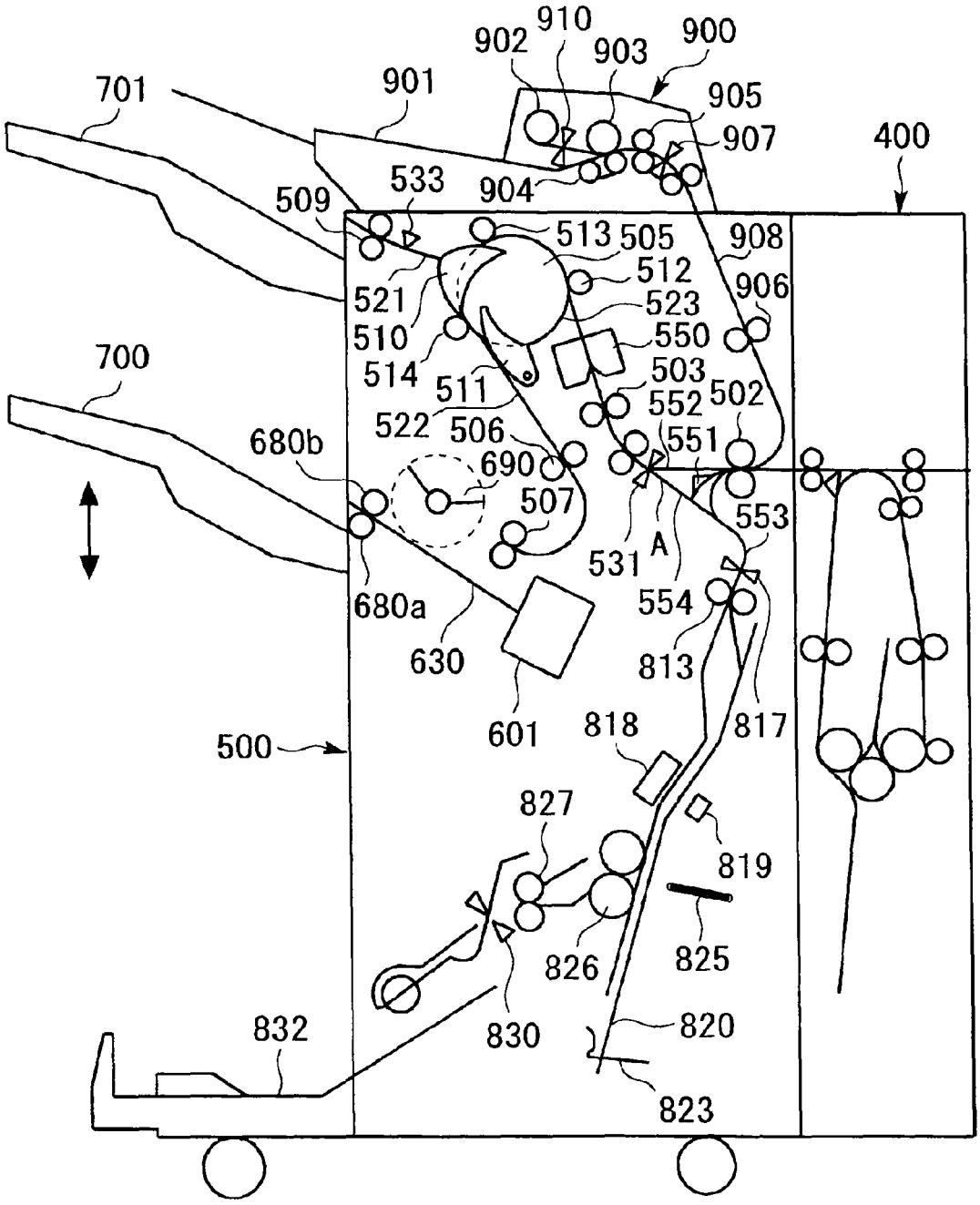
FIG. 3 is a schematic sectional view that shows a configuration of a finisher.

As shown in FIGS. 1 and 3, the folding device 400 is arranged between the image forming apparatus main body 10 and the finisher 500 as an expandable optional unit. The folding device 400 performs a folding process on the sheet conveyed from the image forming apparatus main body 10 if it is necessary to do so. The folding device 400 will not be described herein in detail.

(Finisher)

A configuration of the finisher 500 will be described.

As shown in FIG. 3, the finisher 500 performs various sheet processes such as a process for bringing sheets discharged from the printer 300 sequentially and registering the sheets thus brought to form the sheets into a sheet bundle, a staple process for stitching the sheet bundle on its trailing end by staples, a punching process for punching the brought sheets near their trailing ends, a stacking process such as sorting and non-sorting, and a book binding process such as folding.

As shown in FIG. 3, the finisher 500 includes a pair of inlet roller (an inlet roller pair) 502 that serves as a reception and conveyance unit for introducing the sheet discharged from the printer 300 (refer to FIG. 1) through the folding device 400 into the finisher 500. A switch flapper 551 that introduces the sheet to a finisher path 552 or a book binding path 553 is provided downstream of this inlet roller pair 502.

The sheet introduced to the finisher path 552 is conveyed to a buffer roller 505 through a pair of conveyance rollers (conveyance roller pair) 503. The conveyance roller pair 503 and the buffer roller 505 are configured to be rotatable in both a forward direction and a backward direction.

An inlet sensor 531 is provided between the inlet roller pair 502 and the conveyance roller pair 503. In adjacent to the upstream of the sheet transport direction of the inlet sensor 531, a linking path 554 serving as a common conveying path that links the finisher path 552 to the book binding path 553 so as to be able to convey the sheet therebetween is branched from the finisher path 552 to extend to the book binding path 553. A point at which the linking path 554 is branched from the finisher path 552 will be referred to as "branch point A" hereinafter. This branch point A forms a branch that includes a one-way mechanism for conveying the sheet only to the linking path 554 side when the conveyance roller pair 503 are inverted to convey the sheet from the conveyance roller pair 503 side to the inlet sensor 531 side.

A punch unit 550, which is provided between the conveyance roller pair 503 and the buffer roller 505, operates if it is necessary to do so, and punches the conveyed sheet near its trailing end.

The buffer roller 505 is a roller on and around an outer peripheral surface of which a predetermined number of sheets can be stacked and wound. Each sheet is wound around the outer peripheral surface of this roller by depression rollers 512, 513, and 514 if it is necessary to do so. The sheet wound around the buffer roller 505 is conveyed in a rotation direction of the buffer roller 505.

A switch flapper 510 is arranged between the depression rollers 513 and 514, and another switch flapper 511 is arranged downstream of the depression roller 514. The switch flapper 510 separates the sheet wound around the buffer roller 505 from the buffer roller 505 and introduces the separated sheet to either a non-sort path 521 or a sort path 522. The switch flapper 511 separates the sheet wound around the buffer roller 505 from the buffer roller 505 and introduces the separated sheet to the sort path 522, or introduces the sheet wound around the buffer roller 505 to a buffer path 523.

The sheet introduced to the non-sort path 521 by the switch flapper 510 is discharged onto a sample tray 701 through a pair of discharge rollers (discharge roller pair) 509. A sheet discharge sensor 533 that detects jamming or the like is provided halfway along the non-sort path 521.

The sheet introduced to the sort path 522 by the switch flapper 510 is stacked on an intermediate tray (hereinafter, "processing tray") 630 through conveyance rollers 506 and 507. The sheets stacked on the processing tray 630 in a state of the sheet bundle are subjected to a registration process, a staple process, and the like if it is necessary to do so, and then discharged onto a stack tray 700 by discharge rollers 680*a* and 680*b*. A stapler 601 is employed for the staple process for stitching the sheet bundle stacked on the processing tray 630. An operation performed by this stapler 601 will be described later. The stack tray 700 is configured to be self-propelled vertically.

(Book Binding Unit)

The sheet from the book binding path 553 and the linking path 554 is stored in a storage guide 820 by a pair of conveyance rollers (conveyance roller pair) 813, and further conveyed until the leading end of the sheet comes in contact with a movable sheet positioning member 823. A book binding inlet sensor 817 is provided upstream side of the conveyance roller pair 813. Two pairs of staplers 818 are provided halfway along the storage guide 820. The staplers 818 are configured to stitch the sheet bundle at its center in cooperation with an opposing anvil 819.

A pair of folding rollers (folding roller pair) 826 are provided downstream position of the staplers 818. A jogger 825 is provided at an opposite position to the folding roller pair 826. This jogger 825 protrudes toward the sheet bundle stored in the storage guide 820. The sheet bundle is pushed out between the folding roller pair 826, folded by the folding roller pair 826, and discharged to a saddle discharge tray 832 through folded sheet discharge rollers 827. A book-bound sheet discharge sensor 830 is arranged downstream side of the folded sheet discharge rollers 827.

If the sheet bundle stitched by the staplers 818 is to be folded, the positioning member 823 is moved downward by a predetermined distance so that a staple position of the sheet bundle after being subjected to the staple process is located at a central position of the roller pair 826.

(Inserter Unit)

The inserter 900, which is provided in an upper portion of the finisher 500, sequentially separates sheet bundles that form a cover and an interleaving paper stacked on a tray 901, and conveys the separated sheet bundles to either the finisher path 552 or the book binding path 553. The inserter 900 is not described herein in detail.

(Block Diagram of Finisher)

Figure 4:
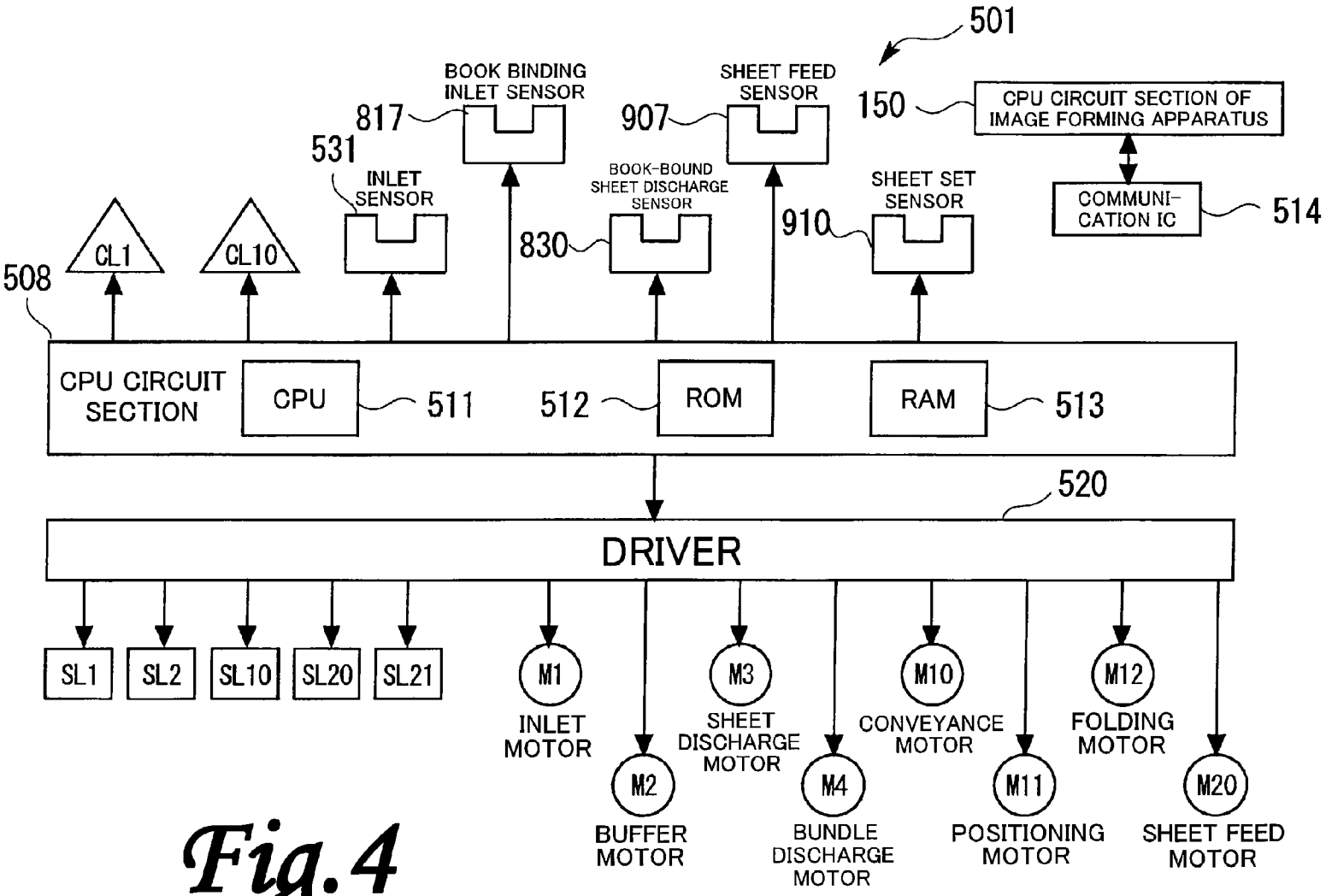
FIG. 4 is a block diagram that shows a finisher controller.

A configuration of the finisher controller 501 that controls the finisher 500 to be driven will be described with reference to FIG. 4. FIG. 4 is a block diagram that shows the configuration of the finisher controller 501 shown in FIG. 2.

As shown in FIG. 4, the finisher controller 501 includes a CPU circuit section 508 including a CPU 511, a ROM 512, a RAM 513 and the like. The CPU circuit section 508 communicates with the CPU circuit section 150 provided in the image forming apparatus main body 10 side through a communication integrated circuit (IC) 514 to exchange data with the CPU circuit section 150, executes various programs stored in the ROM 512 based on a command from the CPU circuit section 150, and controls the finisher 500 to be driven.

When the CPU circuit section 508 executes this driving control, detection signals are brought into the CPU circuit section 150 from various sensors. The various sensors include the inlet sensor 531, the book binding inlet sensor 817, the book-bound sheet discharge sensor 830, a sheet feed sensor 907, and a sheet set sensor 910. The sheet set sensor 910 detects whether a special sheet is set on the tray 901 of the inserter 900. A driver 520, which is connected to the CPU circuit section 508, drives motors and solenoids based on signals from the CPU circuit section 508. The CPU circuit section 150 also drives clutches.

The motors include an inlet motor M1 that is a drive source of the inlet roller pair 502, the conveyance roller pair 503, and the conveyance roller pair 906, a buffer motor M2 that is a drive source of the buffer roller 505, a sheet discharge motor M3 that is a drive source of the conveyance roller pair 506, the discharge roller pair 507, and the discharge roller pair 509, a bundle discharge motor M4 that drives the discharge rollers 680*a* and 680*b*, a conveyance motor M10 that is a drive source of the conveyance roller pair 813, a positioning motor M11 that is a drive source of the sheet positioning member 823, a folding motor M12 that is a drive source of the jogger 825, the folding roller pair 826, and the folded sheet discharge roller pair 826, and a sheet feed motor M20 that is a drive source of a sheet feed roller 902, a conveyance roller 903, a branch path belt 904, and a withdrawal roller pair 905 of the inserter 900.

Each of the inlet motor M1, the buffer motor M2, and the sheet discharge motor M3 consists of a stepping motor and can rotates the roller pair driven by the motor at a uniform velocity or a particular velocity by controlling a excitation pulse rate.

Each of the inlet motor M1 and the buffer motor M2 can be driven to rotate in both forward and backward directions by the driver 520.

Each of the conveyance motor M10 and the positioning motor M11 consists of a stepping motor, and the folding motor M12 consists of a direct-current (DC) motor. The conveyance motor M10 is configured to be able to convey a sheet at a velocity synchronized with the velocity of the inlet motor M1.

The sheet feed motor M20 consists of a stepping motor and is configured to be able to convey a sheet at a velocity synchronized with the velocity of the inlet motor M1.

The solenoids include a solenoid SL1 that switches over the switch flapper 510, a solenoid SL2 that switches over the switch flapper 511, a solenoid SL10 that switches over the switch flapper 551, a solenoid SL20 that drives a sheet feed shutter (not shown in FIG. 3) of the inserter 900, and a solenoid SL21 that drives the sheet feed roller 902 of the inserter 900 to be moved up and down.

The clutches include a clutch CL1 that transmits driving of the folding motor M12 to the jogger 825 and a clutch CL10 that transmits driving of the sheet feed motor M20 to the sheet feed roller 902.

(Operation Unit)

Figure 5A:
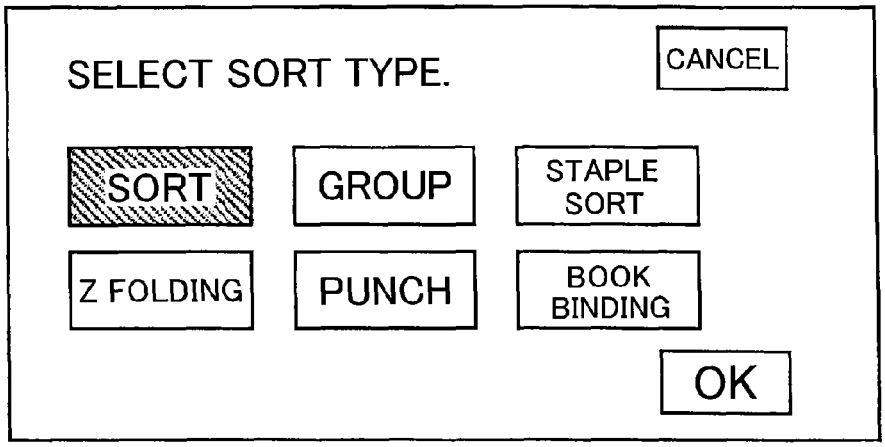
FIG. 5A is a plan view that shows an operation unit provided in the image forming apparatus.
Figure 5B:
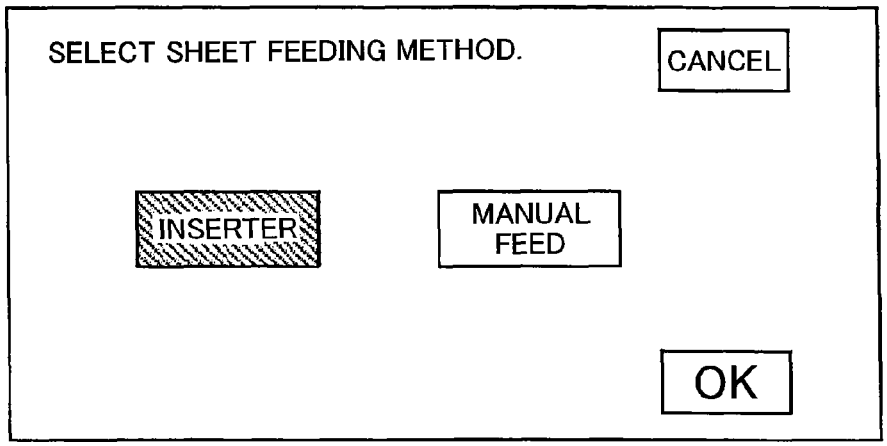
FIG. 5B is a plan view that shows the operation unit provided in the image forming apparatus.
Figure 5C:
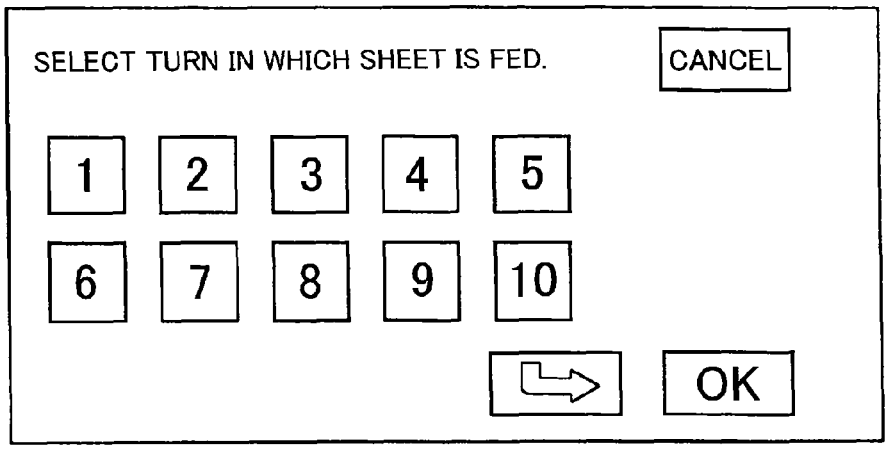
FIG. 5C is a plan view that shows the operation unit provided in the image forming apparatus.

An example of an operation for selecting one of the sheet processing modes using the operation unit 153 shown in FIG. 2 will be described with reference to FIGS. 5A, 5B, and 5C. FIGS. 5A, 5B, and 5C show examples of a screen related to the sheet processing mode selection operation performed by the operation unit 153.

The image forming apparatus according to this embodiment includes various processing modes including a non-sort mode, a sort mode, a staple sort mode (stitching mode), and a book binding mode as sheet processing modes. In addition, the image forming apparatus includes an interleaving mode in which the image forming apparatus is set to be able to insert an inserted sheet as a sheet inserted halfway so as to serve as a cover or a final sheet.

Setting of the sheet processing mode is made by an input operation on the operation unit 153. For example, if a menu select screen shown in FIG. 5A is displayed on the operation unit 153, a desired sheet processing mode is set using this menu select screen. FIG. 5B shows a menu screen for selecting a sheet feeding method. FIG. 5C shows a menu screen for selecting a turn of the special sheet in which turn the special sheet is fed from the inserter 900.

(Outline of Operation in Staple Sort Mode (for Half-Size Sheet))

A flow of sheets when M sheet bundles each of which includes N pages of half-size sheets each having one-sided printed surface are prepared by the staple sort process will be described with reference to FIGS. 6 to 11. In FIGS. 6 to 11, a sheet number is denoted by P(□-○). Symbol "□" denotes a bundle number and symbol "○" denotes a page number. For example, if a sheet is an eighth page of a fifth bundle, the sheet number is denoted by P(5-8). For convenience of description, each sheet is indicated by a thick line and a gap is kept between superimposed sheets in the drawings. In addition, the sheet is shown at a position shifted on purpose from the conveying path so as to distinguish the sheet from the conveying path. Actually and needless to say, the sheets are superimposed without gaps and conveyed along the conveying path.

Figure 6:
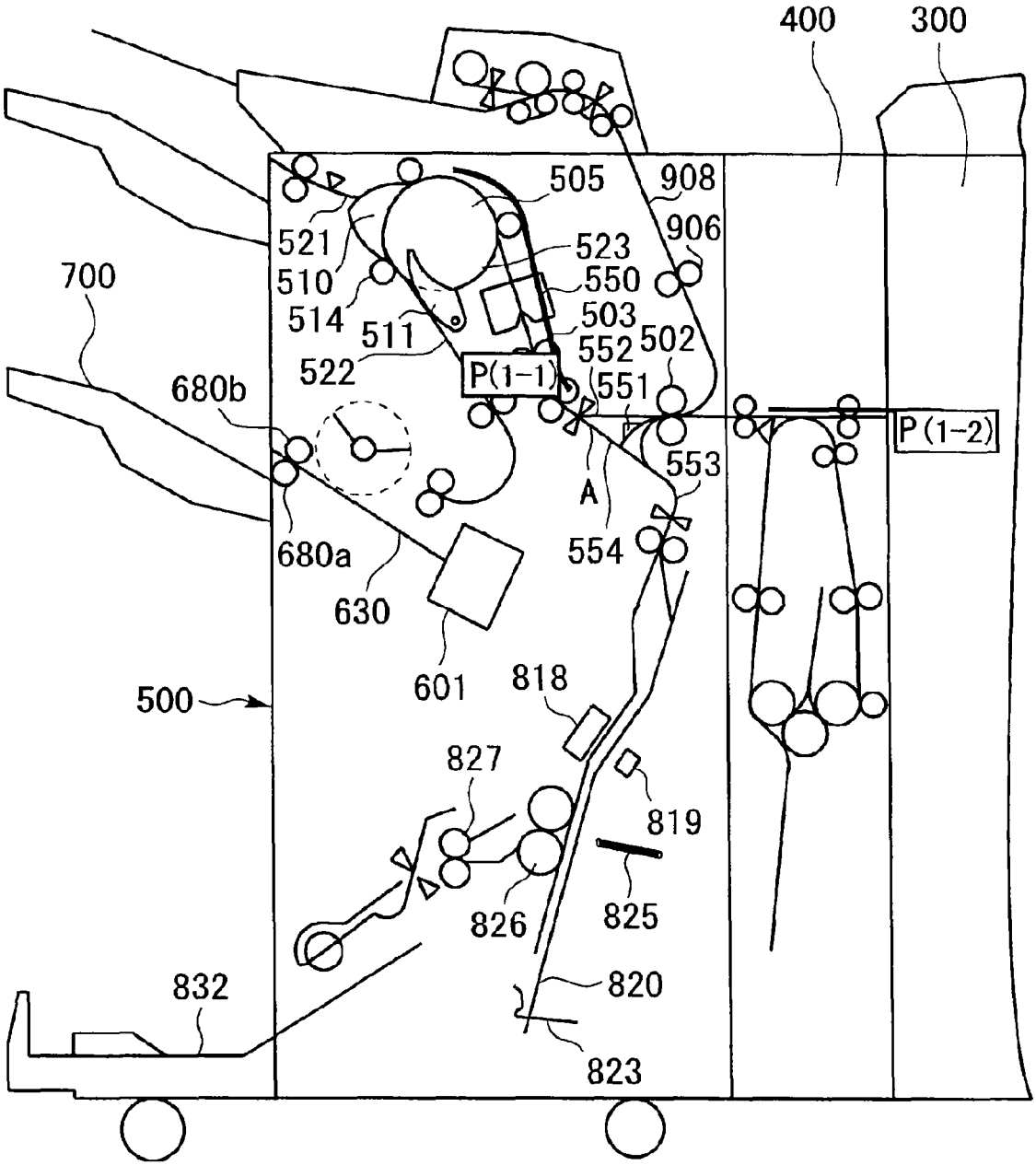
FIG. 6 is an explanatory view for an operation performed on a half-size one-sided sheet in a staple sort mode.
Figure 7:
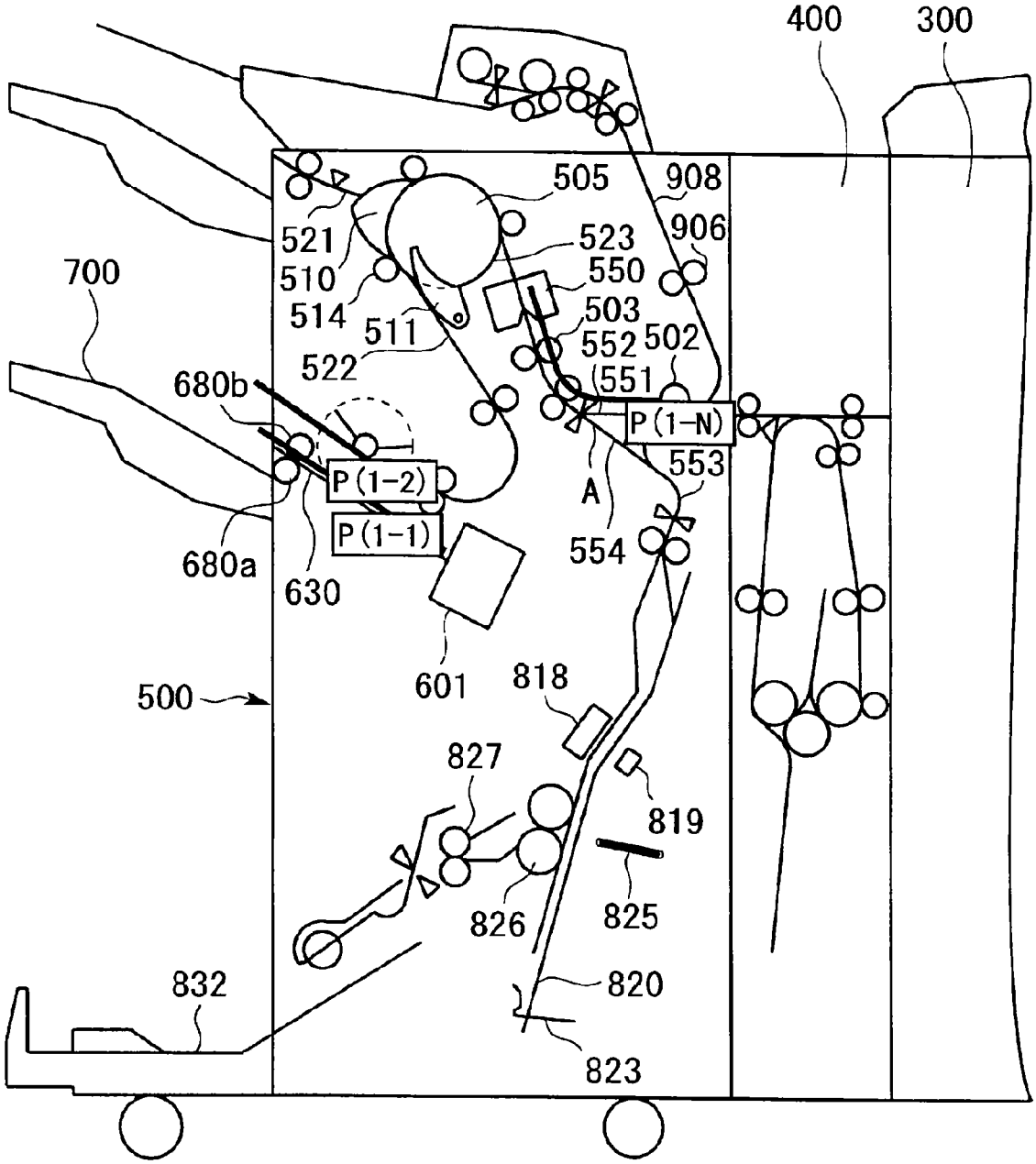
FIG. 7 is an explanatory view for an operation subsequent to the operation shown in FIG. 6.

A sheet P(1-1) on which an image is formed by the printer 300 is inverted and discharged by and from the printer 300, introduced into the finisher 500, and introduced to the sort path 522 through the buffer roller 505 (refer to FIG. 6). At this time, both of the switch flappers 510 and 511 are switched over to the sort path 522 side.

The sheet P(1-1) introduced to this sort path 522 is stored on the processing tray 630 with an image-formed surface turned down. Likewise, a sheet P(1-2) discharged next from the printer 300 at a predetermined interval is introduced into the finisher path 552, stored on the processing tray 630 through the buffer roller 505 and the sort path 522, and stacked on the sheet P(1-1) (refer to FIG. 7). Likewise, sheets up to a final page of a sheet P(1-N) are stored on the processing tray 630 (refer to FIG. 8).

Figure 9:
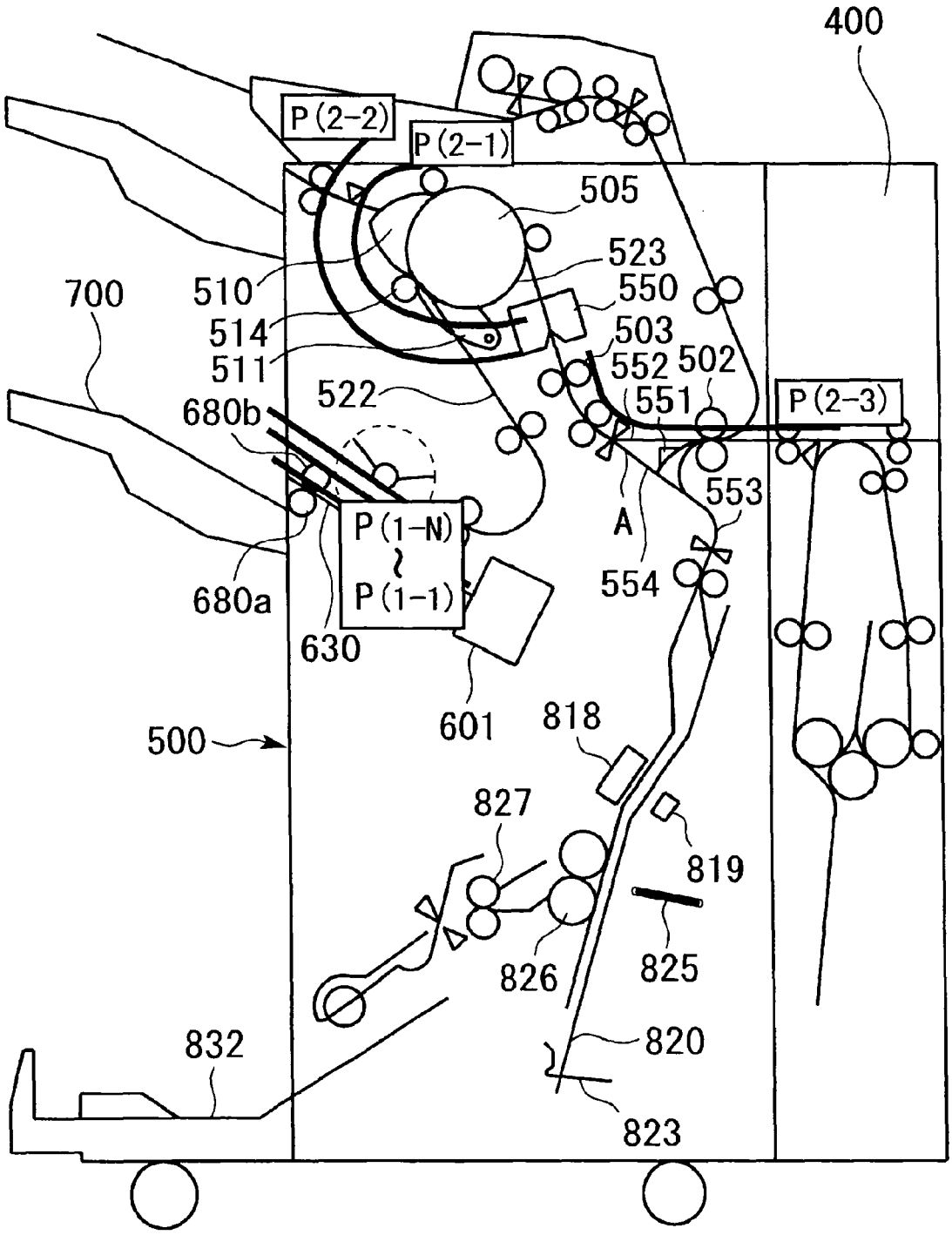
FIG. 9 is an explanatory view for an operation subsequent to the operation shown in FIG. 8.

A first sheet bundle consisting of sheets P(1-1) to P(1-N) stored on the processing tray 630 is collectively subjected to the stitching process by the stapler 601 and discharged onto the stack tray 700 by the discharge rollers 680*a* and 680*b* (refer to FIG. 9).

Figure 8:
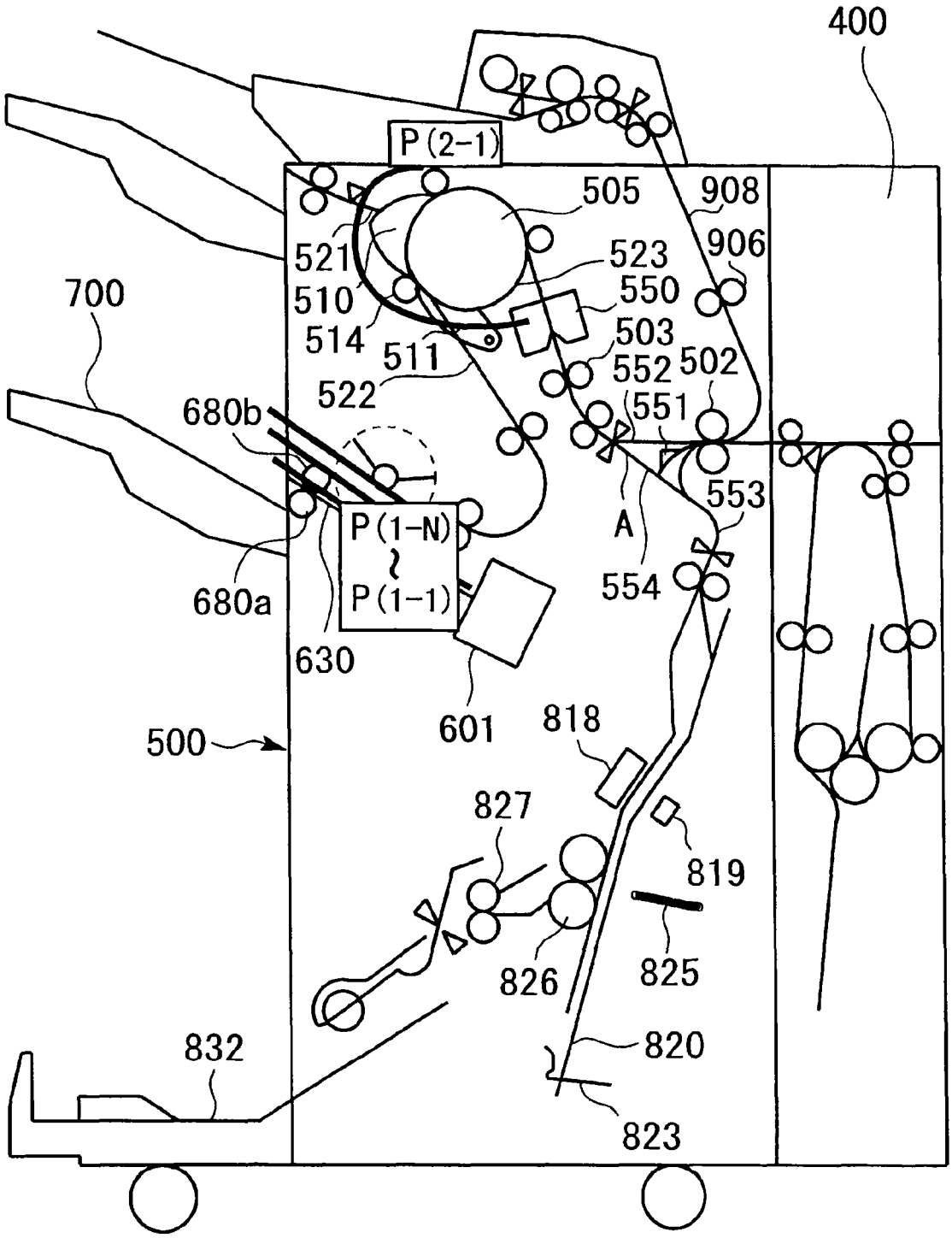
FIG. 8 is an explanatory view for an operation subsequent to the operation shown in FIG. 7.

On the other hand, a leading sheet P(2-1) of a second sheet bundle output from the printer 300 at the same interval as that of the final sheet P(1-N) of the first sheet bundle is temporarily held on the buffer path 523 on standby by the switch flapper 511 switched over to the buffer path 523 side (refer to FIG. 8).

In this first embodiment, processing time for the process with respect to the processing tray 630 is set to time required to superimpose three sheets. Therefore, the outline of an operation according to the superimposition of three sheets will be described. Since the processing time with respect to the processing tray 630 is changed according to the type of process, the processing time is adjusted by changing the number of superimposed sheets according to the processing time.

When a next sheet P(2-2) is introduced into the finisher path 552, the buffer roller 505 is activated at predetermined timing. In addition, the leading sheet P(2-1) is joined again on the finisher path 552, and the leading sheet P(2-1) and the next sheet P(2-2) are superimposed while a leading end of the sheet P(2-1) is made to generally coincide with that of the sheet P(2-2). After being conveyed again by the buffer roller 505, the both sheets P(2-1) and P(2-2) are temporarily held on the buffer path 523 on standby by the switch flapper 511 switched over to the buffer path 523 side. When a third sheet P(2-3) is introduced to the finisher path 552, the buffer roller 505 is activated at predetermined timing. In addition, the leading sheet P(2-1) and the next sheet P(2-2) are joined again on the finisher path 552, and the sheets P(2-1) and P(2-2) are superimposed on the sheet P(2-3) while leading ends of the respective sheets are made to generally coincide with one another. Thus, the storage of the first sheet bundle is completed (refer to FIGS. 9 and 10).

Figure 10:
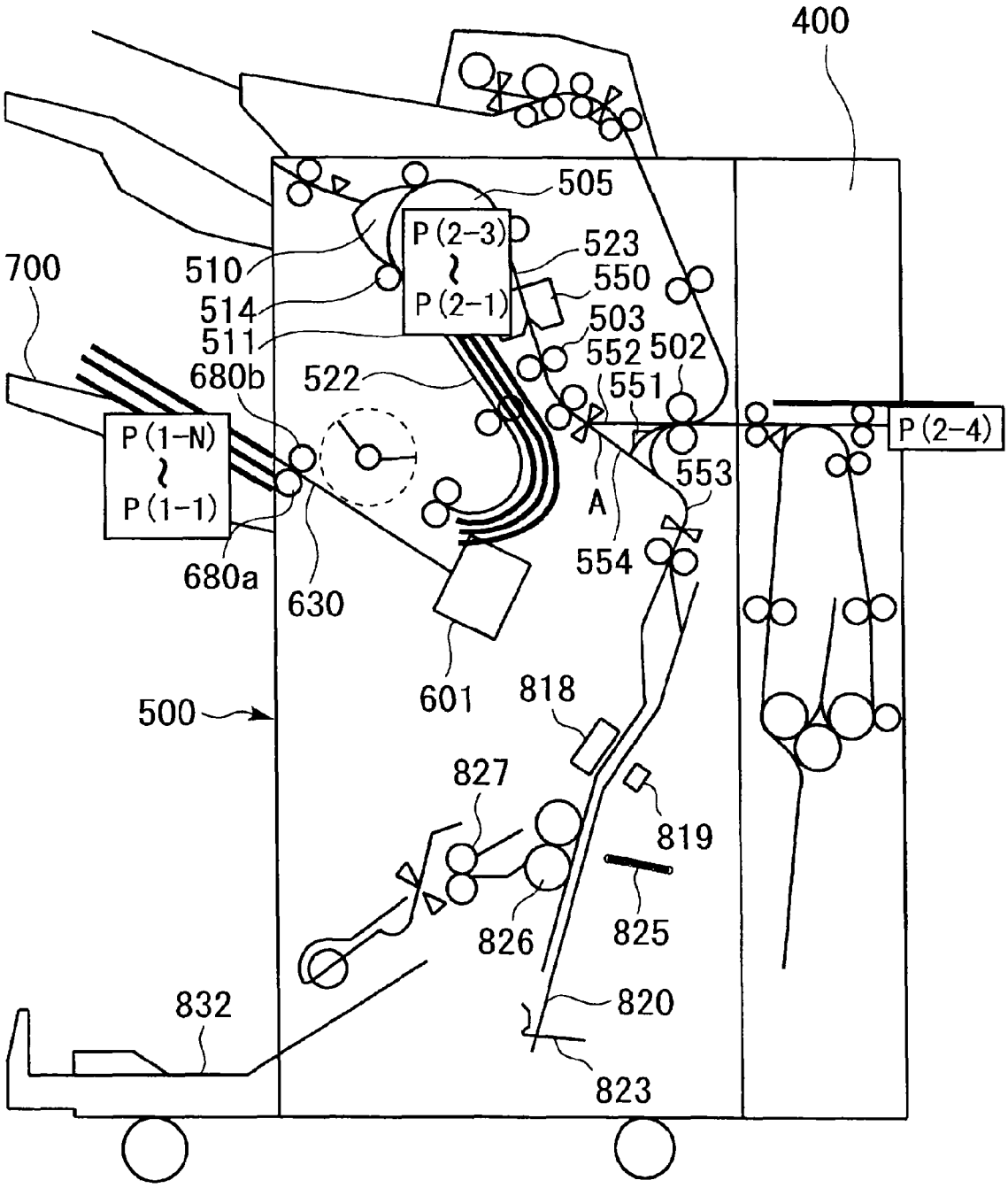
FIG. 10 is an explanatory view for an operation subsequent to the operation shown in FIG. 9.
Figure 11:
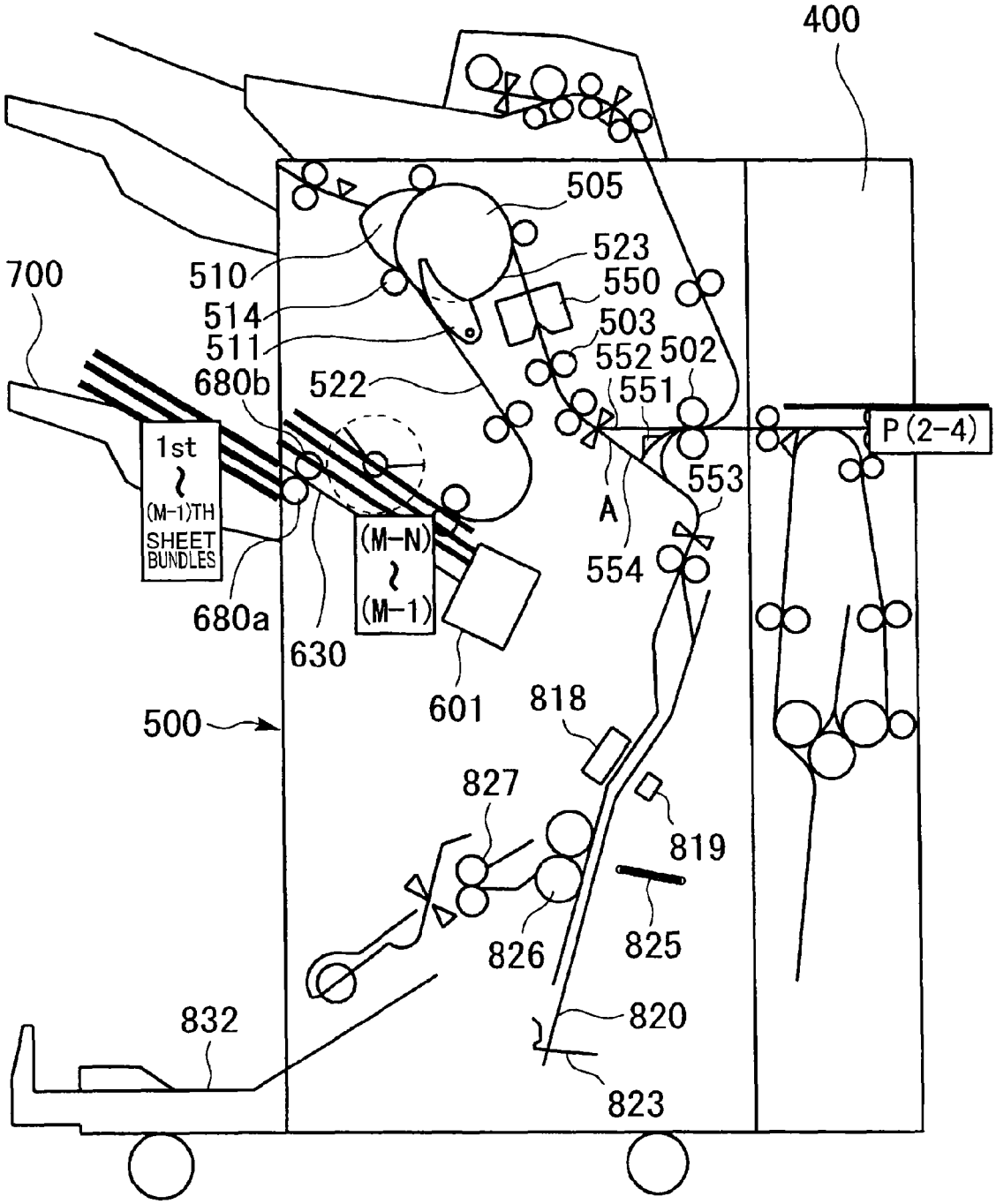
FIG. 11 is an explanatory view for an operation subsequent to the operation shown in FIG. 10.
Figure 12:
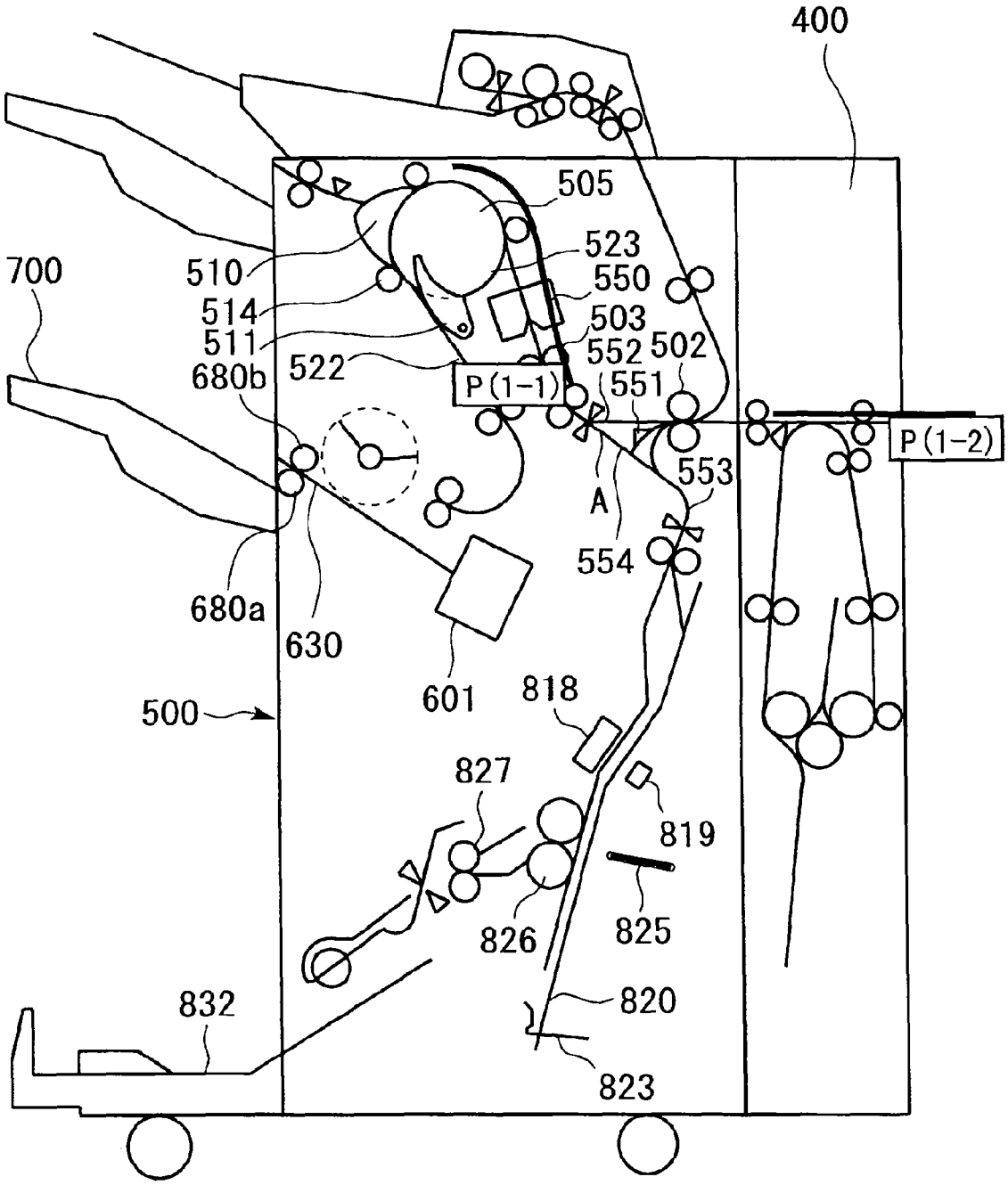
FIG. 12 is an explanatory view for operation performed on a large-size one-sided sheet in the staple sort mode.
Figure 13:
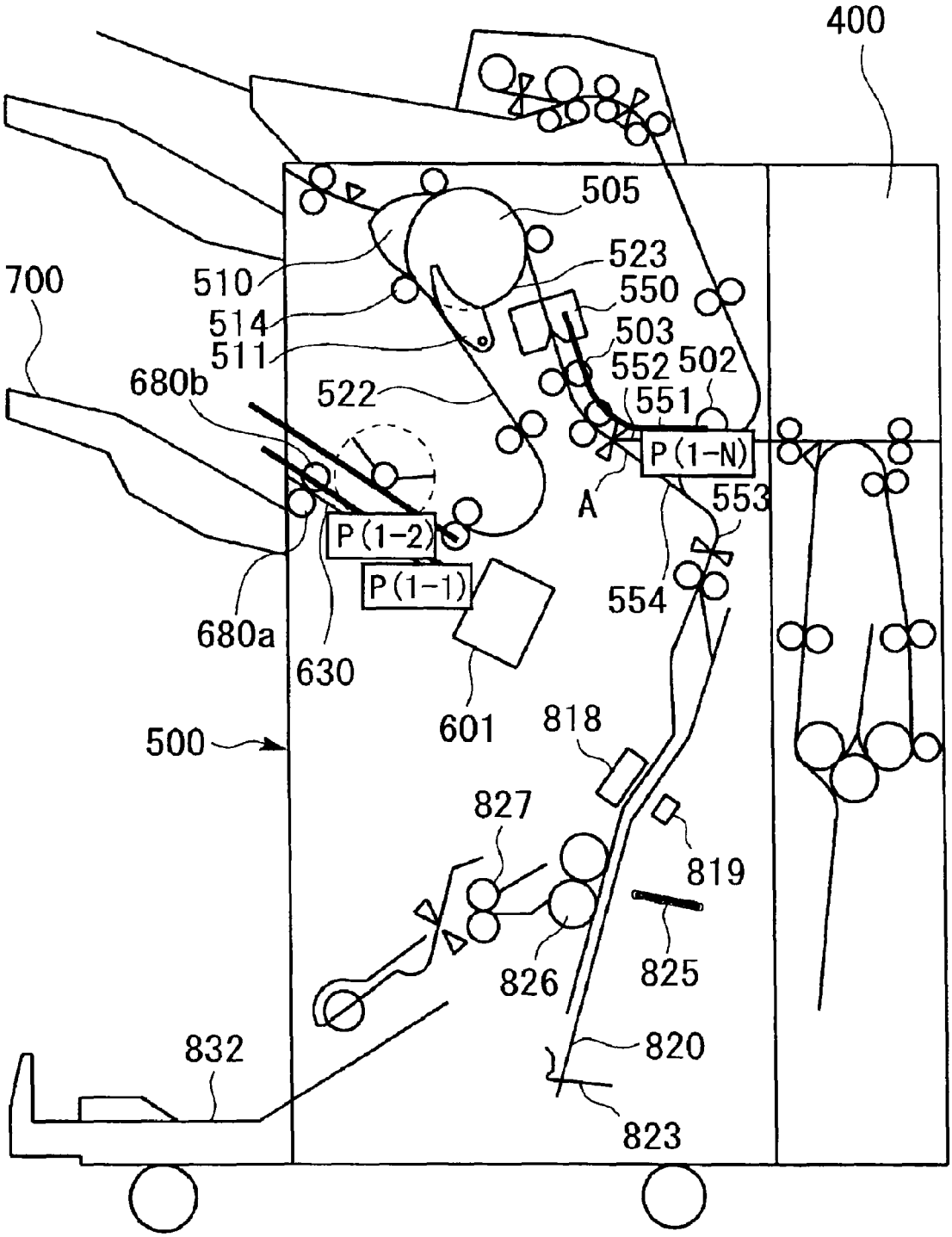
FIG. 13 is an explanatory view for an operation subsequent to the operation shown in FIG. 12.

The sheet bundle consisting of three sheets thus superimposed is stored on the processing tray 630 from which the preceding bundle is discharged and which is evacuated (refer to FIG. 10). Similarly to the first sheet bundle, a fourth sheet and the following sheets P(2-4) to P(2-N) are stacked on the sheet bundle and stored on the processing tray 630, thereby completing storing the second sheet bundle. Likewise, after conveying sheet bundles up to a final or $M^{th}$ sheet bundle, the process is finished (refer to FIG. 11).

As mentioned above, by thus configuring the image forming apparatus, it is unnecessary to stop printer output and productivity during the staple sort mode process can be thereby improved for the half-size sheets.

(Outline of Operation in Staple Sort Mode (for Large-Size Sheet))

Next, a flow of sheets when M sheet bundles each of which includes N pages of large-size sheets each having one-sided printed surface are prepared by the staple sort process will be described with reference to FIGS. 12 to 17. In FIGS. 12 to 17, a sheet number is denoted, similarly to that for the half-size sheet, by P(□-○). For convenience of description, each sheet is indicated by a thick line and a gap is kept between superimposed sheets in the drawings. In addition, the sheet is shown at a position shifted on purpose from the conveying path so as to distinguish the sheet from the conveying path. Actually and needless to say, the sheets are superimposed without gaps and conveyed along the conveying path.

A leading sheet P(1-1) of a first sheet bundle on which an image is formed by the printer 300 is inverted and discharged by and from the printer 300, introduced into the finisher 500, introduced to the sort path 522 through the buffer roller 505, and stored on the processing tray 630. A flow of sheets P(1-2) to P(1-N) of the first sheet bundle is the same as that of half-size sheets, which will not be described herein in detail (refer to FIGS. 12 and 13).

Figure 14:
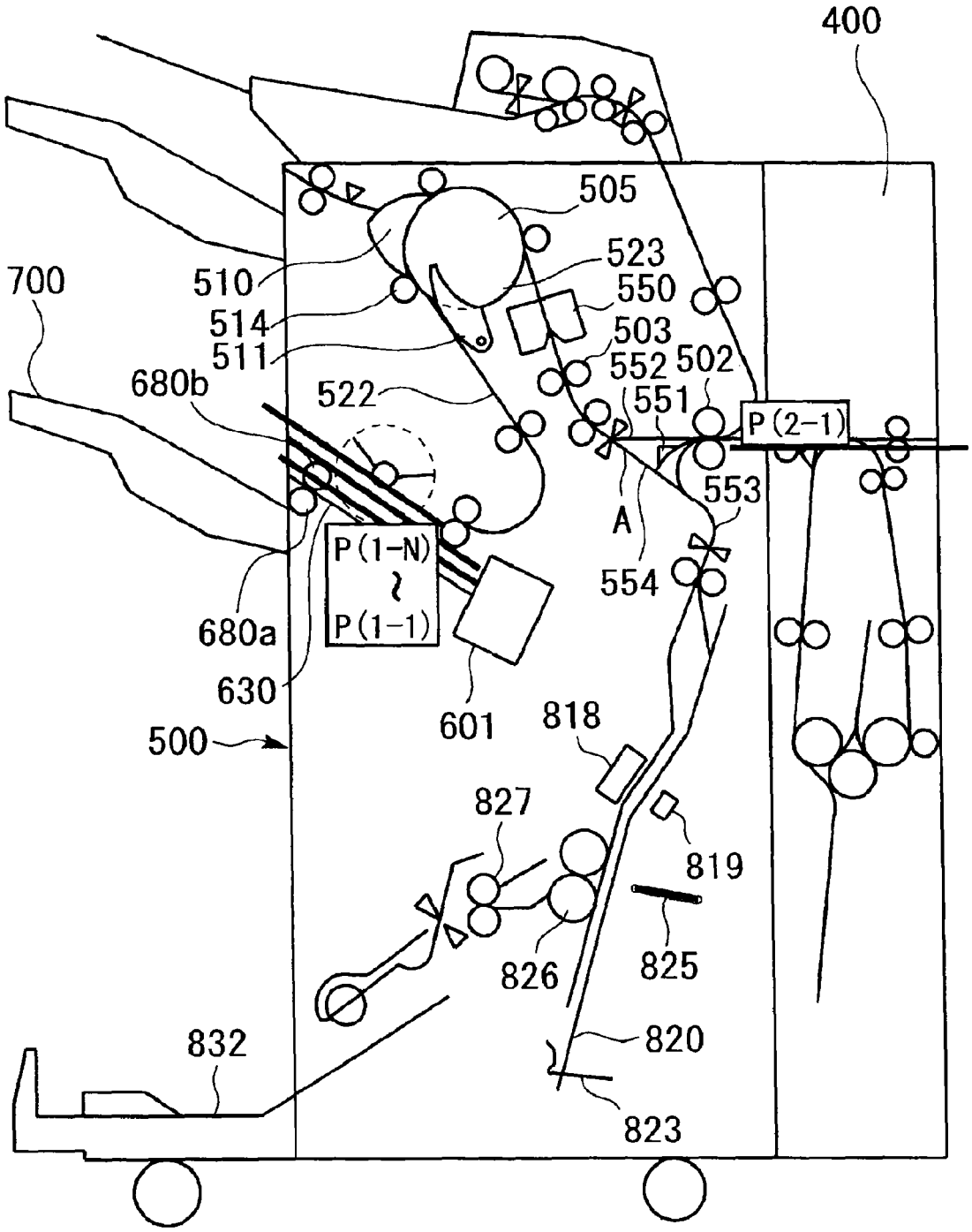
FIG. 14 is an explanatory view for an operation subsequent to the operation shown in FIG. 13.

A leading sheet P(2-1) of a second sheet bundle output from the printer 300 at the same interval as that of the final sheet P(1-N) of the first sheet bundle is introduced into the finisher 500 in a state in which the sheet P(2-1) is not inverted and discharged (i.e., an image-formed surface of the sheet P(2-1) is turned upward and leading and trailing ends of the sheet P(2-1) on the image while the sheet P(2-1) is being conveyed are opposite to those of the sheets of the first bundle) (refer to FIG. 14).

Figure 15:
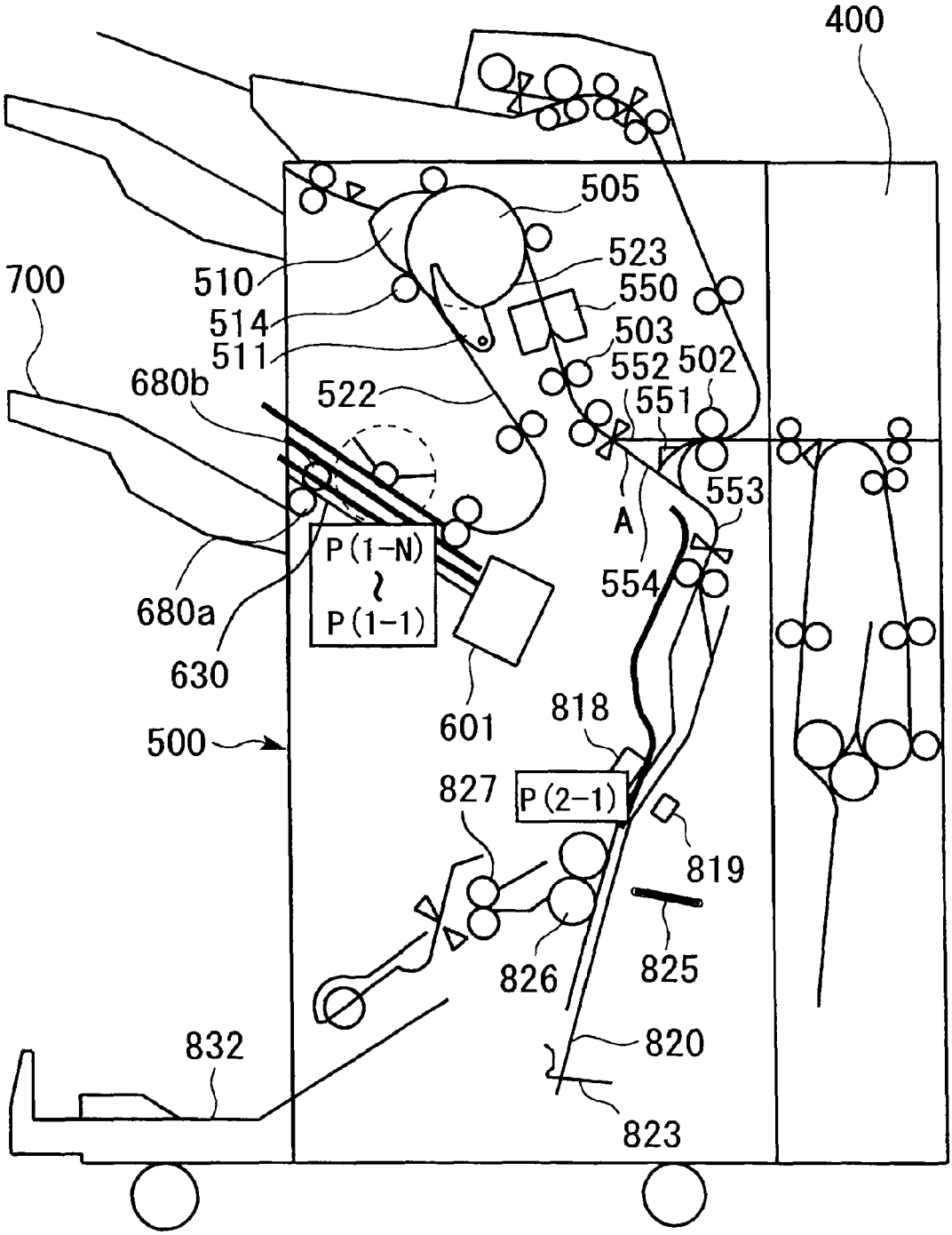
FIG. 15 is an explanatory view for an operation subsequent to the operation shown in FIG. 14.
Figure 16:
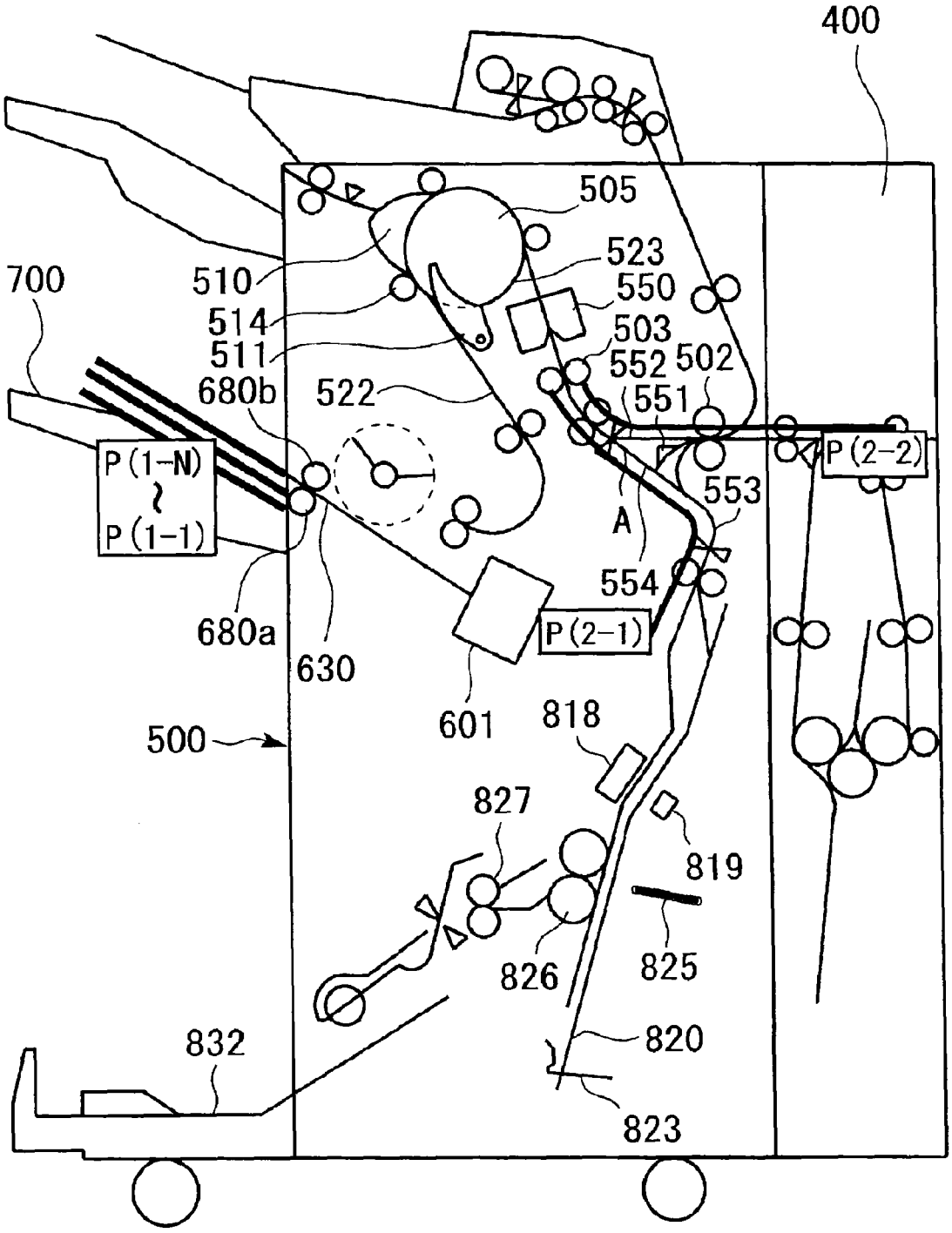
FIG. 16 is an explanatory view for an operation subsequent to the operation shown in FIG. 15.

The leading sheet P(2-1) is temporarily introduced to the book binding path 553 and held on standby by the switch flapper 551 switched over to the book binding path 553 side (refer to FIG. 15). When a next sheet P(2-2) is introduced toward the finisher path 552, the sheet P(2-2) is inverted, discharged, and introduced to the finisher path 552 by the switch flapper 551 switched over to the finisher path 552 side from the book binding path 553 side before the sheet P(2-2) is introduced. At the same time, the sheet P(2-1) is conveyed at predetermined timing to the linking path 554 with the trailing end of the sheet P(2-1) on the image when being introduced to the book binding path 553 set as a leading end, and superimposed on the next sheet P(2-2) while the leading end is made to generally coincide with that of the next sheet P(2-2) (refer to FIG. 16).

The sheet P(2-1) is inverted by being introduced to the book binding path 553. The next sheet P(2-2) is already inverted and discharged. Due to this, a second surface (rear surface) of the leading sheet P(2-1) on which surface no image is formed, out of a first surface (front surface) on which an image is formed and the second surface (rear surface), is superimposed on the first surface of the next sheet P(2-2) on which surface an image is formed. During this time, the first sheet bundle consisting of the sheets P(1-1) to P(1-N) is discharged from the processing tray 630 to the stack tray 700, so that the processing tray 630 is evacuated. In the drawings, a state in which the leading sheet P(2-1) and the second sheet P(2-2) are superimposed is shown while a gap is formed therebetween so as to facilitate distinction therebetween.

Figure 17:
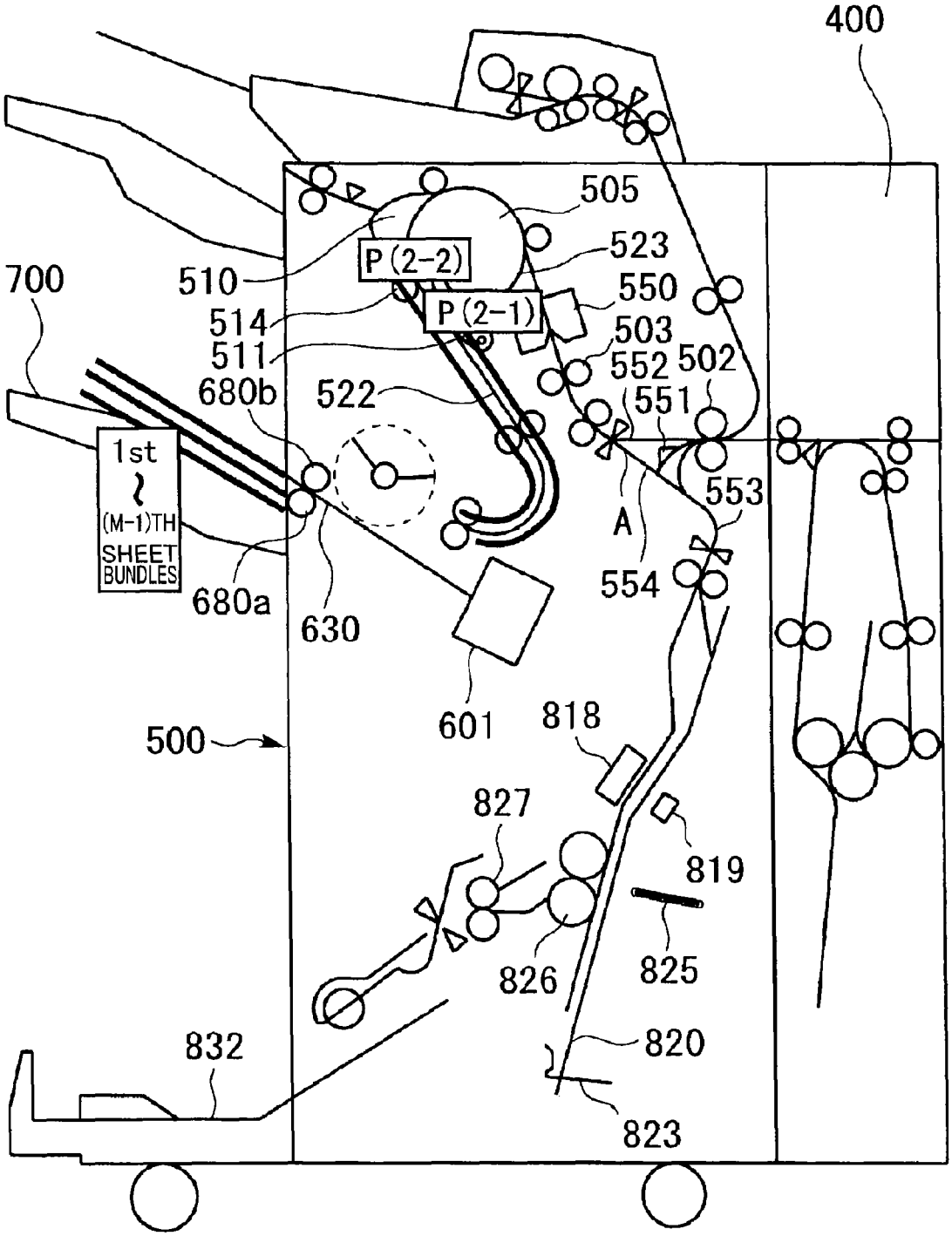
FIG. 17 is an explanatory view for an operation subsequent to the operation shown in FIG. 16.

The sheet bundle of the two sheets thus superimposed is conveyed to the sort path 522 so as to be stored on the evacuated processing tray 630 (refer to FIG. 17).

Thereafter, similarly to the first sheet bundle, a third sheet and the following sheets P(2-3) to P(2-N) are inverted and discharged, superimposed on the leading sheet P(2-1) and the next sheet P(2-2) on the processing tray 630, and stored on the processing tray 630, thus completing the second sheet bundle. Likewise, after being conveyed, sheet bundles up to the final or $M^{th}$ sheet bundle, thus finishing the process.

As mentioned above, by thus configuring the image forming apparatus, it is unnecessary to stop printer output and productivity during the staple sort mode process can be thereby improved even for the large-size sheets.

(Outline of Image Formation and Basic Operation in Book Binding Mode)

The image formation in the book binding mode will be described mainly referring to FIGS. 18A, 18B, and 18C.

Figure 18A:
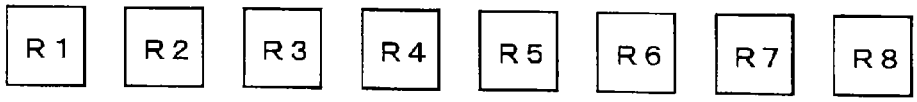
FIG. 18A is an explanatory view for image formation when the image forming apparatus is in a book binding mode.
Figure 18B:
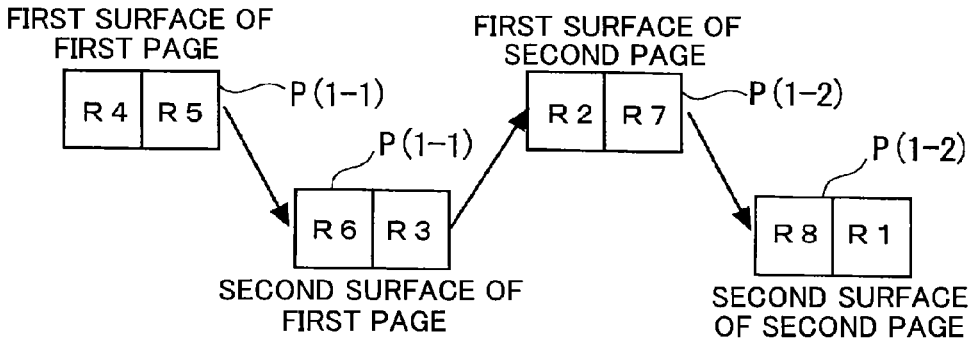
FIG. 18B is an explanatory view for image formation when the image forming apparatus is in the book binding mode.
Figure 18C:
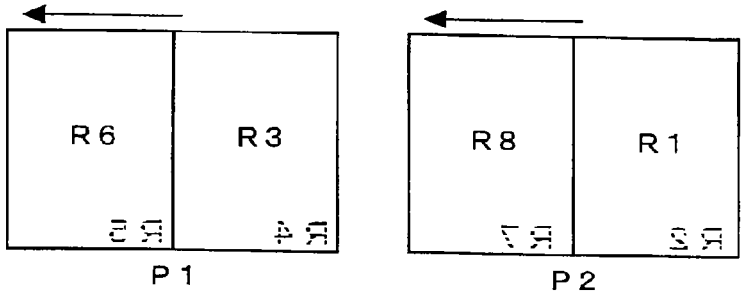
FIG. 18C is an explanatory view for image formation when the image forming apparatus is in the book binding mode.

FIGS. 18A, 18B, and 18C are explanatory views for the image formation when the image forming apparatus shown in FIG. 1 is in the book binding mode. If the book binding mode is selected, a setting is made such that images can be formed on a left half and a right half on each of front and rear surfaces of one sheet, i.e., four pages in all. A predetermined number of such sheets are bound into a sheet bundle, the sheet bundle is stitched at its center, and a twofold booklet is then formed. The controller that controls entirety of the image forming apparatus so as to make pages correctly continuous in a state of the twofold booklet determines an imaging order, imaging positions, presence or absence of inverted conveying, and the like.

If the book binding mode is designated by key operation of the operation unit 153 shown in FIG. 2, the image forming apparatus reads the originals set on the document conveying apparatus 100 (refer to FIG. 1) sequentially from a leading page. The image forming apparatus stores images of the read originals sequentially in a hard disk, not shown, and at the same time, counts the number of the read originals.

Upon completion of reading the originals, the image forming apparatus classifies the read original images according to the following equation (1) and determines the imaging order and the imaging positions.

$$R=n\times 4-k \quad (1)$$

(R: the number of originals; n: integer equal to or greater than 1 and the number of sheets; and k: any one of 0, 1, 2, and 3)

Since the technique for controlling the imaging order and the imaging positions is well-known per se, it will not be described herein in detail.

The image formation in the book binding mode will be described while referring to an instance in which the number of read originals is eight. As shown in FIG. 18A, pieces of original image data (R1 to R8) corresponding to eight pages are stored in the hard disk in order of read. It is noted that numbers 1 to 8 next to a letter R denote orders of read, and that data of a smaller number is data on the earlier read image stored in the hard disk. However, images are not always formed on the sheets in the same order of image data.

For each image data (R1 to R8), an imaging order and an imaging position are determined. For example, as shown in FIG. 18B, after a mirror image processing, the image R4 and the image R5 are formed on the left half and the right half of the first surface (front surface) of the first sheet P(1-1), respectively. After being inverted by the inversion operation of the flapper 121 and the discharge rollers 118, the sheet P(1-1) is introduced to the both-side conveying path 124 shown in FIG. 1. The sheet P(1-1) is fed again to the transfer unit 116, and the image R6 and the image R3 are formed on the left half and the right half of the second surface (rear surface) of the sheet P(1-1), respectively.

Figure 19:
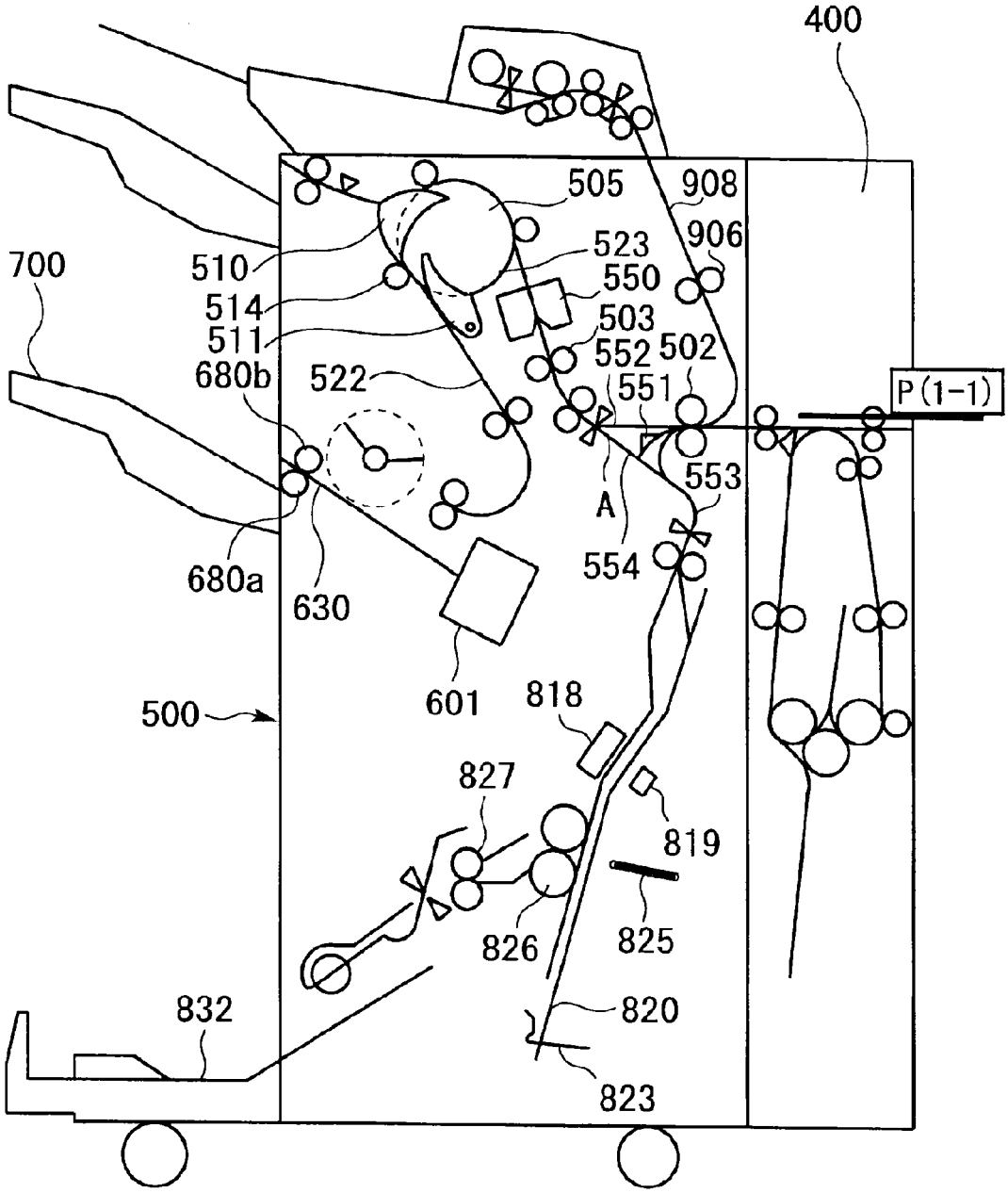
FIG. 19 is an explanatory view for an image forming operation when the image forming apparatus in the book binding mode.
Figure 19:
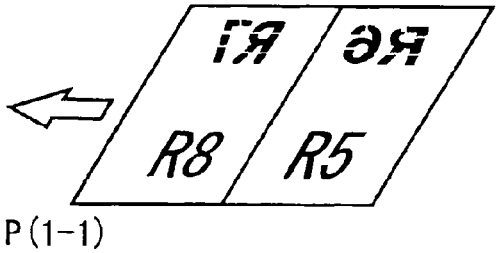

The sheet P(1-1) on which images are thus formed in both sides is conveyed to the book binding path 553 of the finisher 500 (refer to FIG. 19). As shown in FIG. 18C, the sheet P(1-1) is conveyed in an arrow direction of the drawing while the second surface on which the image R6 and the image R3 are formed is turned upward and the image R6 is set as a leading image.

Next, the image R2 and the image R7 are formed on the left half and the right half of the first surface (front surface) of the sheet P(1-2) of the second page, respectively. Similarly to the sheet P(1-1), the sheet P(1-2) is introduced to the both-side conveying path 124 and then subjected to the same process as that on the sheet P(1-1). Namely, after being inverted, this sheet P(1-2) is fed again to the transfer unit 116. In addition, the image R8 and the image R1 are formed on the left half and the right half of the second surface (rear surface) of the sheet P(1-2), respectively.

The sheet P(1-2) is conveyed to the book binding path 553 of the finisher 500. As shown in FIG. 18C, the sheet P(1-2) is conveyed in an arrow direction of the drawing while the second surface on which the image R8 and the image R1 are formed is turned upward and the image R8 is set as a leading image.

Figure 18D:
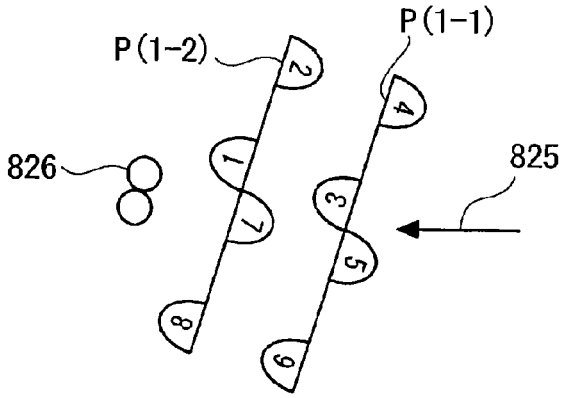
FIG. 18D is an explanatory view for image formation when the image forming apparatus is in the book binding mode.

The respective sheets P(1-1) and P(1-2) are introduced into and stored in the storage guide 820 through the book binding path 553 of the finisher 500. In this storage guide 820, the sheet P(1-1) is stored in the jogger 825 side and the sheet P(1-2) is stored in the folding roller pair 826 side, as shown in FIG. 18D. In addition, the sheets P(1-1) and P(1-2) are stored in the storage guide 820 while the first surfaces of the sheets P(1-1) and P(1-2) are turned to the jogger 825 side.

The sheets P(1-1) and P(1-2) are positioned in the storage guide 820 in the sheet conveying direction by the positioning member 823. In the first embodiment, the storage guide 820 is inclined so that the second sheet P(1-2) is loaded on the first sheet P(1-1). The jogger 825 is arranged on the first sheet P(1-1) side. The imaging order, the imaging positions, the presence or absence of inverted conveyance, and the like are, therefore, determined as mentioned above. However, the imaging order, the imaging positions, the presence or absence of inverted conveyance, and the like are determined so as to make pages correctly continuous in the state in which the sheets are formed into the twofold booklet, depending on the arrangement configuration of the storage guide 820, the jogger 825, or the like.

(Outline of Operation in Book Binding Mode)

A flow of sheets in the book binding mode if the number of pages is three (the number of originals is twelve) and the number of sheet bundles is M will be described with reference to FIGS. 19 to 24. In FIGS. 19 to 24, a sheet number is denoted by P(□-○) similarly to the staple sort mode. Symbol "□" denotes a bundle number and symbol "○" denotes a page number of a sheet bundle which is applied image-sheet treating. For example, if a sheet is a first page of a fifth bundle, the sheet number is denoted by P(5-1).

Figure 20:
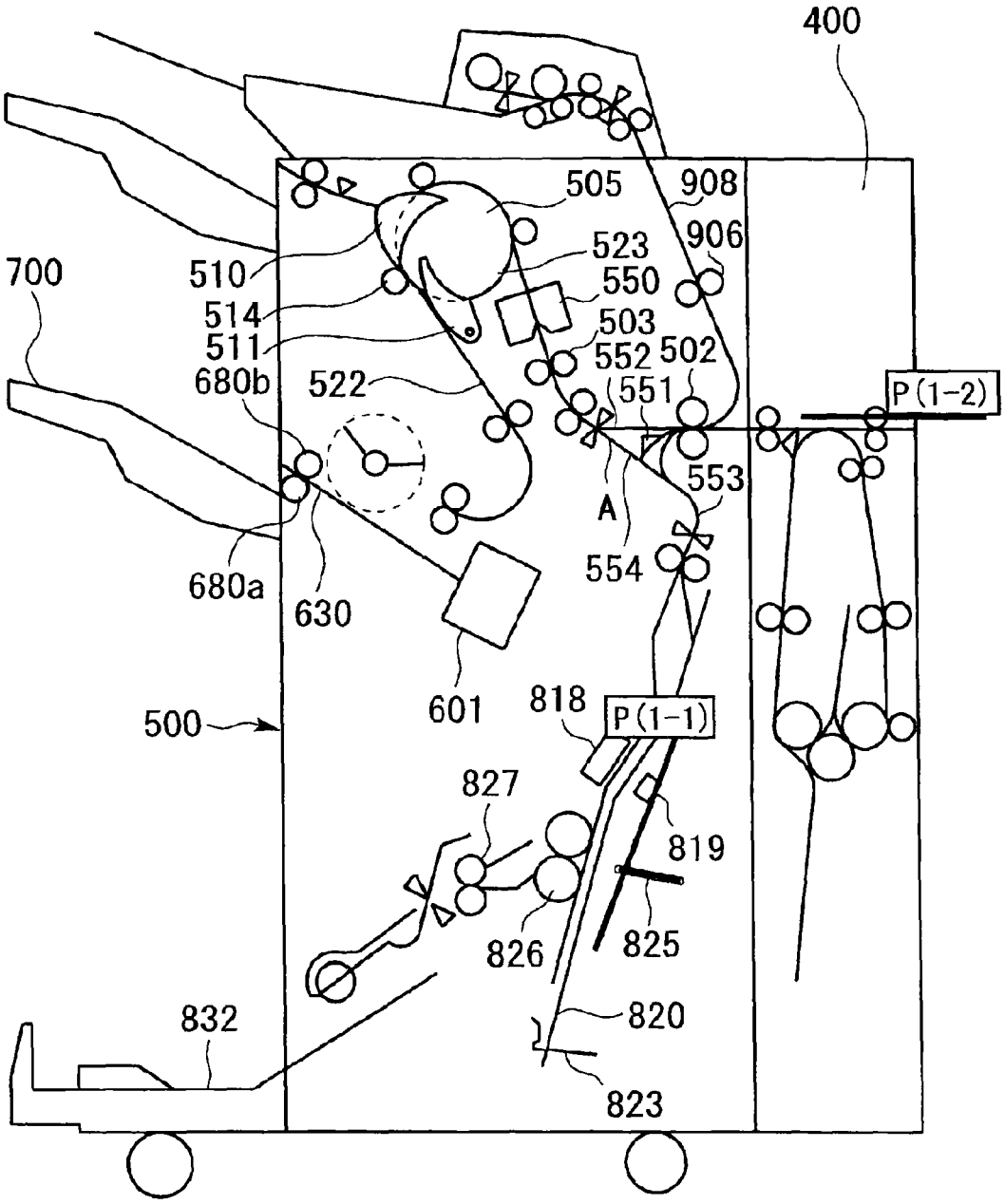
FIG. 20 is an explanatory view for an operation subsequent to the operation shown in FIG. 19.
Figure 20:
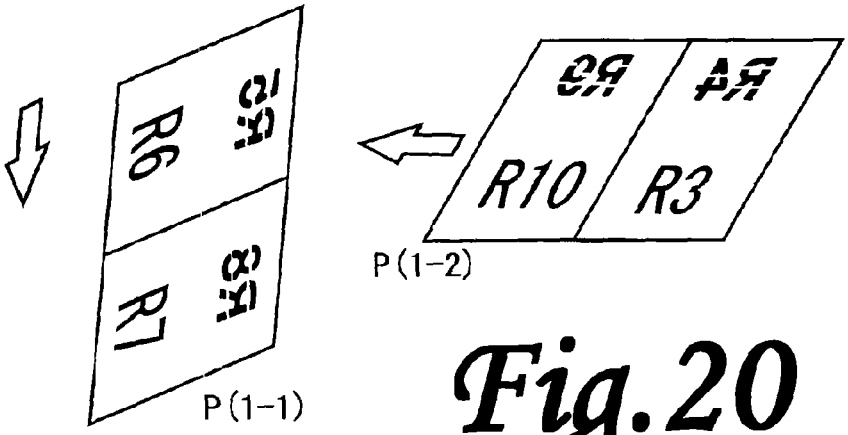

The sheet P(1-1) on the front and rear surfaces of which images are formed by the printer 300 is introduced into the finisher 500 while the first surface is turned downward and the image data having a greater original page is set as a leading image as already mentioned (with reference to FIGS. 18A to 18D) (refer to FIG. 19), introduced to the book binding path 553 by the switch flapper 551, and then stored in the storage guide 820 (refer to FIG. 20).

Figure 21:
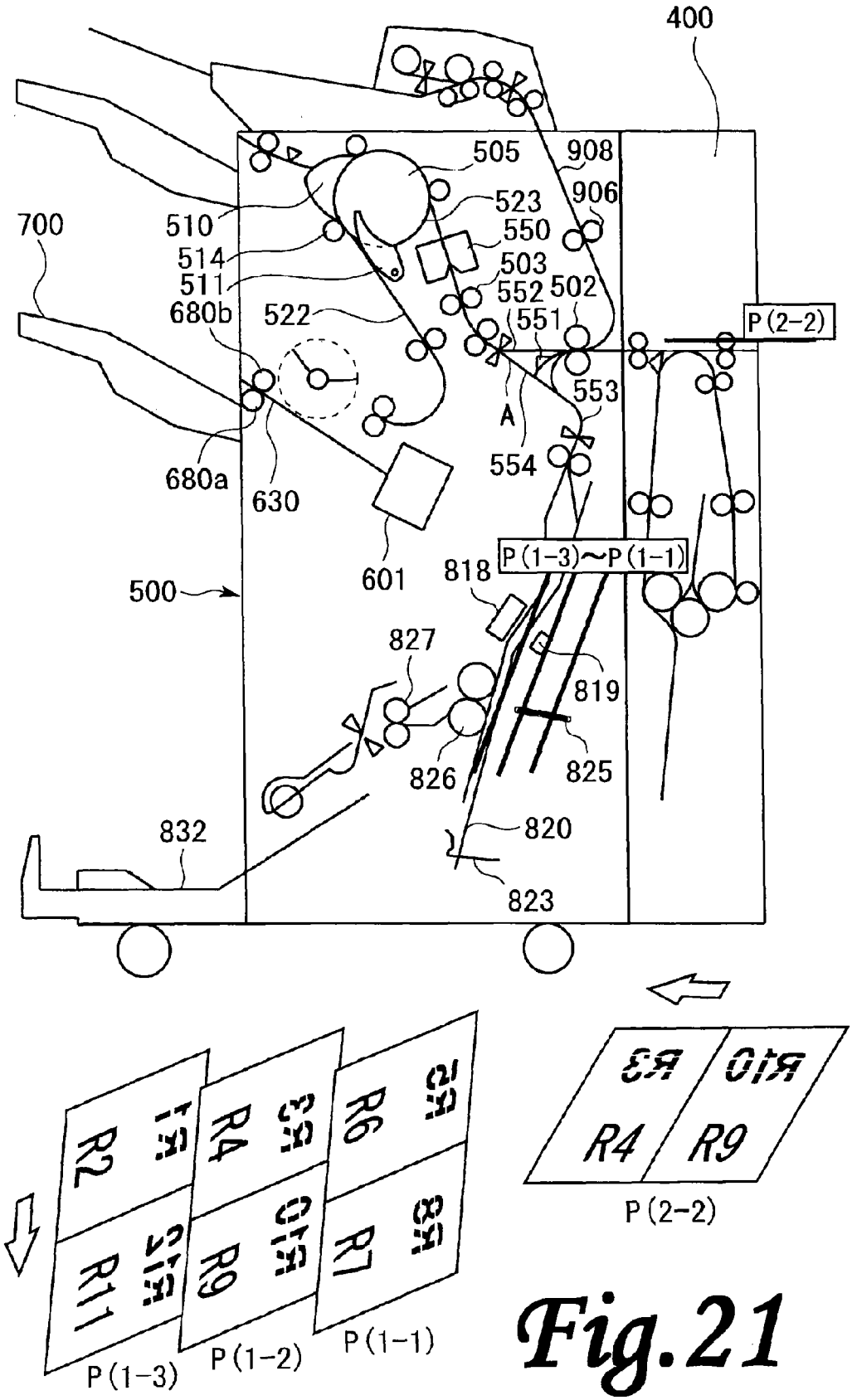
FIG. 21 is an explanatory view for an operation subsequent to the operation shown in FIG. 20.

Likewise, the subsequent sheet P(1-2) is introduced into the finisher 500 while a predetermined interval is kept from the preceding sheet P(1-1), the first surface of the sheet P(1-2) is turned downward, and the image data having a greater original page is set as a leading image, introduced to the book binding path 553 by the switch flapper 551, and then stored in the storage guide 820 on the left of the sheet P(1-1) (refer to FIG. 21).

Further, the sheet P(1-3) of the final page is introduced into the finisher 500 while a predetermine interval is kept from the preceding sheet P(1-2), the first surface of the sheet P(1-3) is turned downward, and the image data having a greater original page is set as a leading image, introduced to the book binding path 553 by the switch flapper 551, and then stored in the storage guide 820 on the left of the sheet P(1-2) (refer to FIG. 21).

Figure 22:
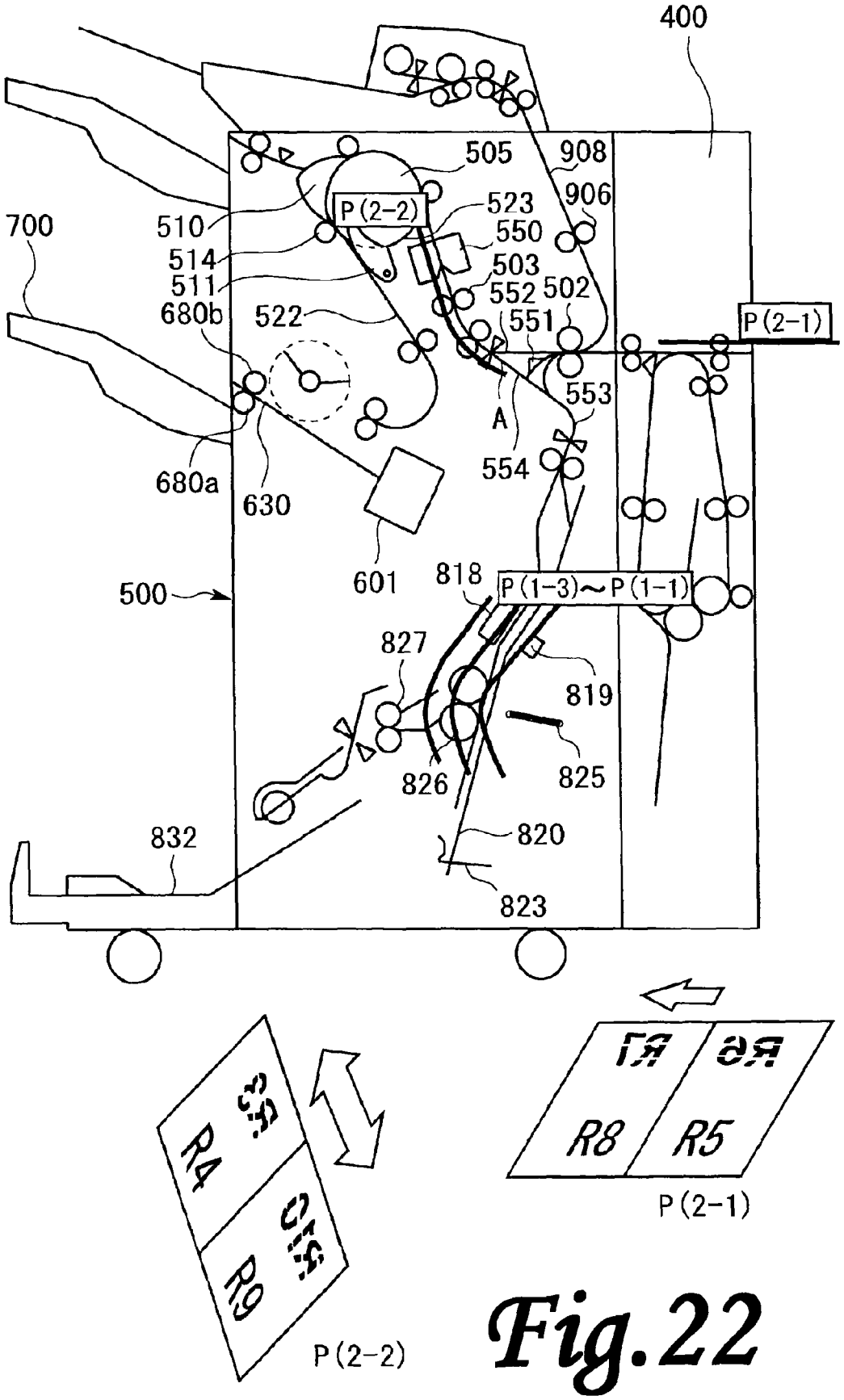
FIG. 22 is an explanatory view for an operation subsequent to the operation shown in FIG. 21.

The sheets P(1-1) to P(1-3) thus stored are registered, stitched by the staplers 818, moved to a predetermined position (downward in the drawing), jogged generally at their centers by the jogger 825, and bent so that the sheet P(1-3) side is convex (refer to FIG. 22).

The bent portions are held between the folding roller pair 826, thereby folding the sheets P(1-1) to P(1-3). The sheets P(1-1) and P(1-3) are introduced to the folded sheet discharge rollers 827 while a folded side is set as a leading end (a fore edge is set as a trailing end), and then discharged to and stacked on the discharge tray 832 (refer to FIG. 23).

On the other hand, as for the second sheet bundle, the sheet P(2-2) is conveyed prior to the sheet P(2-1). The sheet P(2-2) is introduced into the finisher 500 while a predetermined interval is kept from the sheet P(1-3), the first surface of the sheet P(2-2) is turned upward, the image data having a greater original page number (number next to R of the image data) is set as a trailing end side. In addition, the original on which images are formed corresponds to the second page of the first sheet bundle. The image R4 and the image R9 are formed on the left half and the right half of the first surface of the sheet P(2-2), respectively. The image R10 and the image R3 are formed on the left half and the right half of the second surface of the sheet P(2-2), respectively. The imaging order may be such that the images are formed first on the first surface that is the front surface, the sheet is inverted, the images are formed on the second surface that is the rear surface, the sheet is inverted and discharged in the printer 300, and the sheet is conveyed into the finisher 500. Alternatively, the imaging order may be such that the images are formed first on the second surface that is the rear surface, then sheet is inverted, the images are formed on the first surface that is the front surface, and the sheet is conveyed into the finisher 500.

The sheet P(2-2) on the front and rear surfaces of which the images are thus formed is conveyed to the finisher path 552 side, stopped at an arbitrary position at which the trailing end of the sheet P(2-2) exceeds the branch point A, and held on standby at the arbitrary position (refer to FIG. 22).

Subsequently to the sheet P(2-2), the sheet P(2-1) is conveyed. Images are formed on the sheet P(2-1) similarly to the sheet P(1-1) that is the first page of the first bundle, the sheet P(2-1) is introduced into the finisher 500 while the first surface is turned downward and the image data having a greater original page number is set as a leading image (refer to FIG. 22), and introduced to the book binding path 553 by the switch flapper 551 (refer to FIG. 23).

Figure 23:
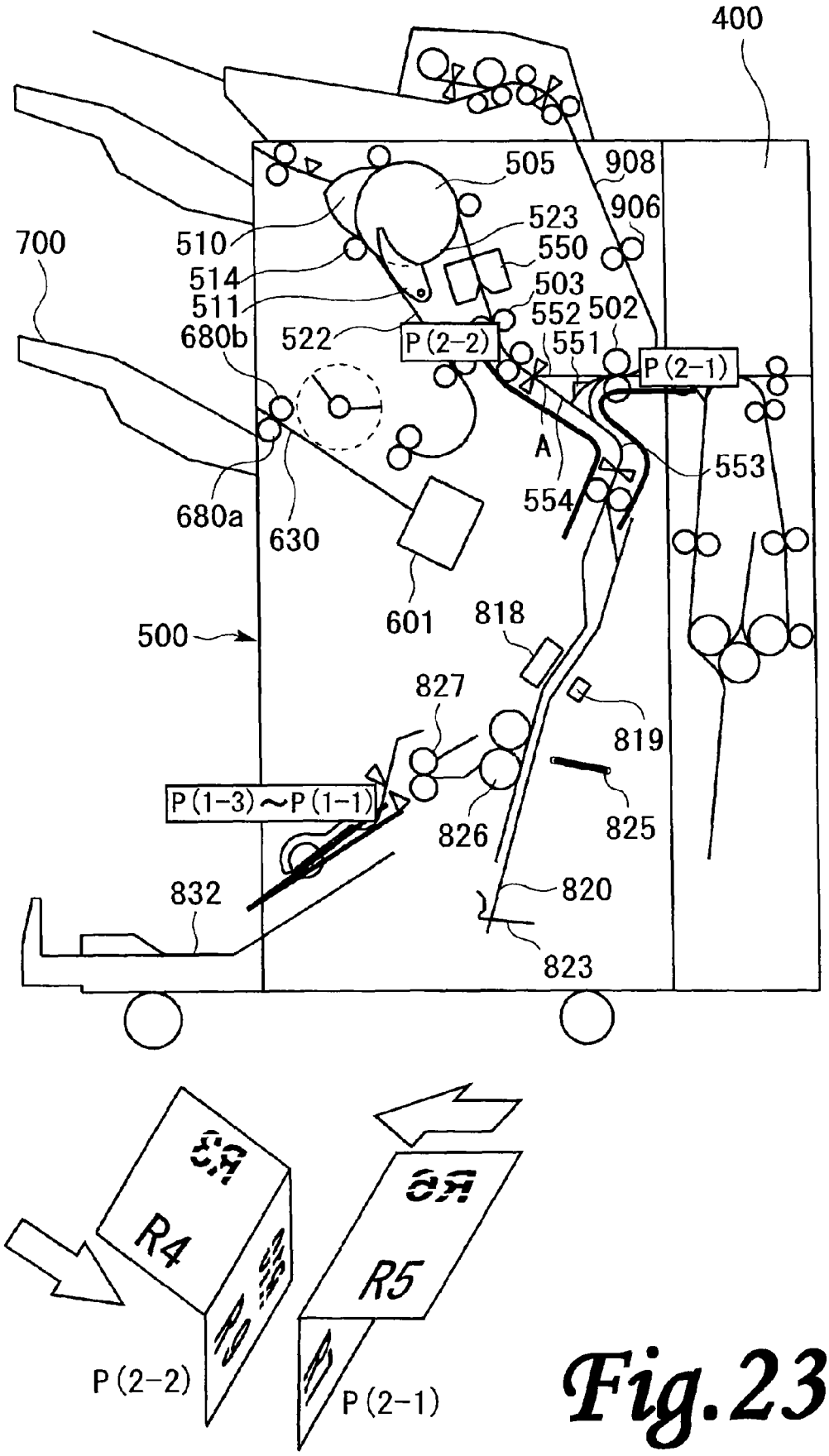
FIG. 23 is an explanatory view for an operation subsequent to the operation shown in FIG. 22.
Figure 24:
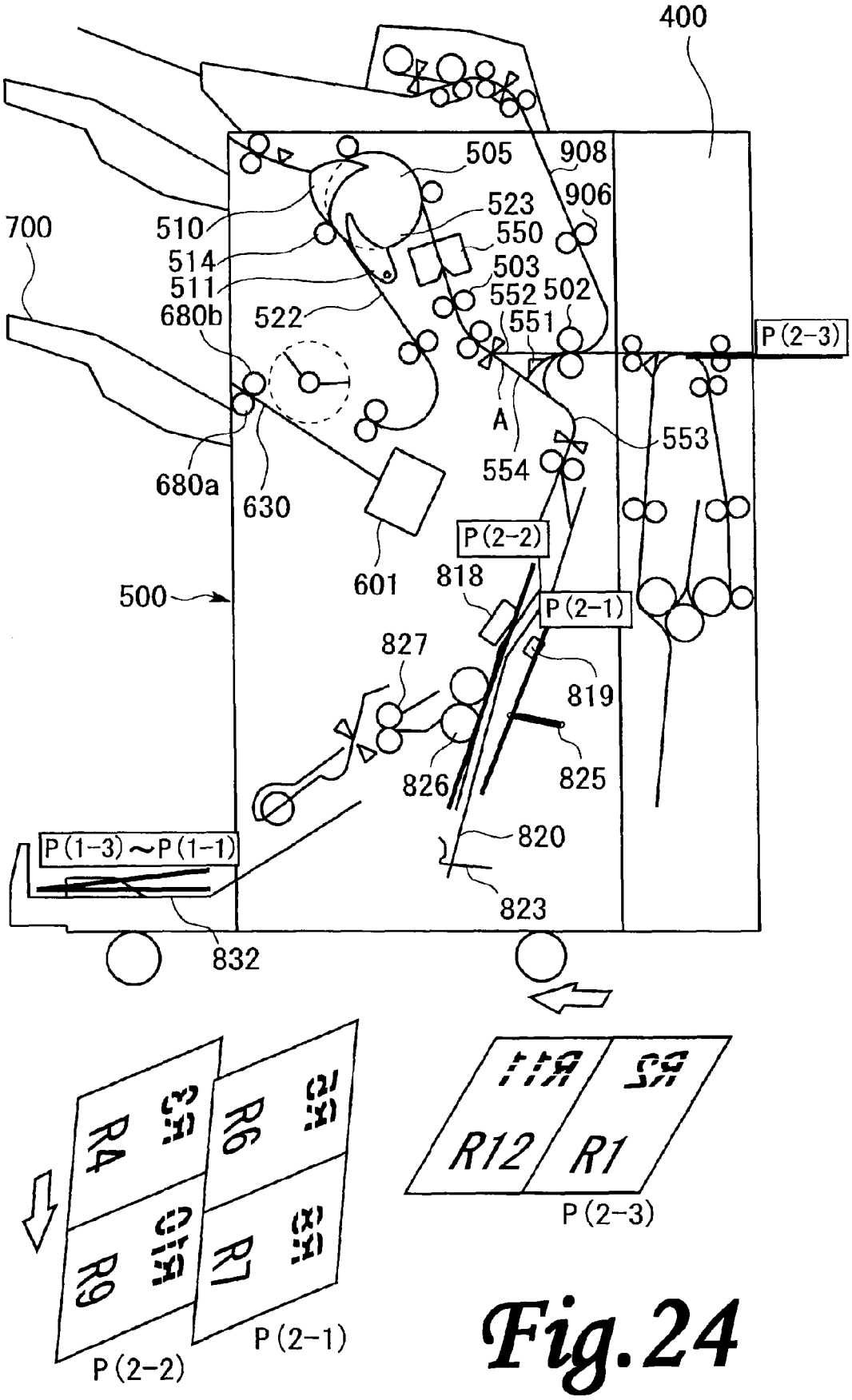
FIG. 24 is an explanatory view for an operation subsequent to the operation shown in FIG. 23.

The sheet P(2-2) is inverted and conveyed at predetermined timing by the conveyance roller pair 503, and introduced to the linking path 554 (refer to FIG. 23). The sheet P(2-2) is then superposed on the left of the sheet P(2-1) on the book binding path 553 while the leading end of the sheet P(2-2) is made to generally coincide with that of the sheet P(2-1) (refer to FIG. 23).

During the above-mentioned operation, the sheets P(1-1) to P(1-3) of the first sheet bundle are folded, and discharged to and stacked on the discharge tray 832. The storage guide 820 is, therefore, evacuated. The sheets P(2-1) and P(2-2) thus superimposed are introduced and stored into the evacuated storage guide 820 (refer to FIG. 24). The sheet P(2-2) is inverted using the finisher path 552, and stored in the storage guide 820 on the left of the sheet P(2-1) while the first surface is turned downward and the image data having a greater original page number is set as a leading image.

Similarly to the sheet P(2-1), the third sheet P(2-3) (refer to FIG. 24) is introduced into the finisher 500 while the first surface is turned downward and the image data having a greater original page number is set as a leading image (refer to FIG. 24), introduced to the book binding path 553 side by the switch flapper 551, and stored in the storage guide 820 on the left of the sheet P(2-2). As a result, the second sheet bundle has a correct page order similarly to the first sheet bundle in the book binding state.

The sheet bundle of the sheets P(2-1) to P(2-3) thus stored is subjected to the stitching process and the folding process similarly to the first sheet bundle, and then discharged and stacked onto the discharge tray 832. The third and the following sheet bundles are treated similarly to the second sheet bundle, thus finishing the book binding operation.

As mentioned above, by thus configuring the image forming apparatus, it is unnecessary to stop printer output and productivity in the book binding mode can be thereby improved.

In the first embodiment mentioned above, a plurality of sheet processing portions arranged longitudinally have been described. Alternatively, the image forming apparatus having the same configuration can be attained even if a plurality of sheet processing portions are arranged laterally.

Figure 25A:
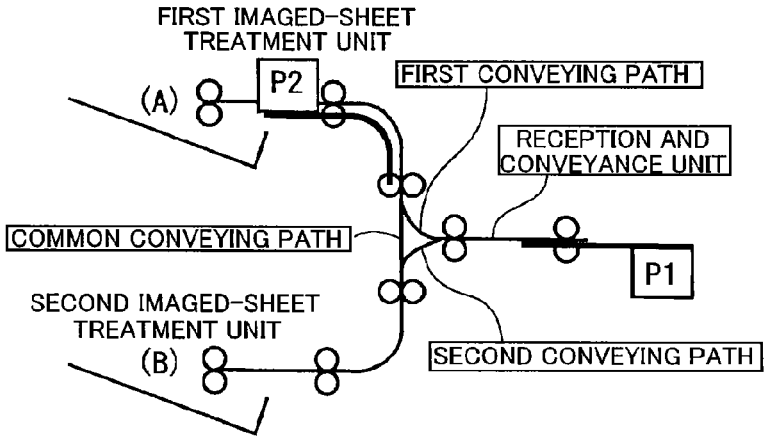
FIG. 25A is a conceptual view of a sheet process.
Figure 25B:
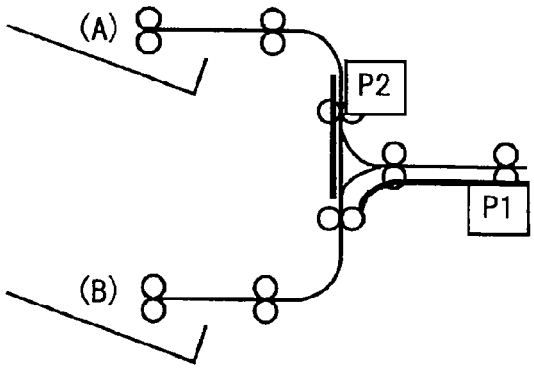
FIG. 25B is a conceptual view of the sheet process.
Figure 25C:
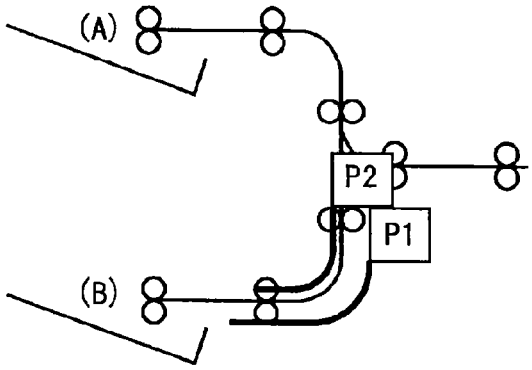
FIG. 25C is a conceptual view of the sheet process.

FIGS. 25A, 25B, and 25C are conceptual views of a sheet process. The conceptual views show that the input roller pair 502 is denoted by "a reception and conveyance unit", the finisher path 552 is denoted by "a first conveying path", the book binding path 553 is denoted by "a second conveying path", the linking path 554 is denoted by "a common conveying path", a unit that performs a series of processes until the sheet is discharged to the stack tray 700 is denoted by "a first processing portion (A)", and a unit that performs a series of processes until the sheet is discharged to the discharge tray 832 is denoted by "a second processing portion (B)".

If the second processing portion (B) performs a sheet process, a preceding sheet (P2) of the next sheet bundle is temporarily conveyed to the first conveying path, and stopped/held on standby (buffered) (refer to FIG. 25A). If a subsequent sheet (P1) is conveyed from the reception and conveyance unit to the second conveying path, then the preceding sheet (P2) is conveyed in an opposite direction to the introduction direction (refer to FIG. 25B) and superimposed on the subsequent sheet (P1) via the common conveying path (refer to FIG. 25C). The both sheets thus superimposed are conveyed to the second processing portion (B) simultaneously.

As can be seen, if the sheet process related to the second sheet process (B) is executed, the finisher path 552 serving as the first conveying path can be said to be a specific conveying path for conveying the sheets devotedly to a specific processing portion among a plurality of sheet processing portion. In addition, the book binding path 553 serving as the second conveying path can be said to be a conveying path other than the specific path or another conveying path for conveying the sheets devotedly to another sheet processing portion other than the specific processing portion.

If the first processing portion (A) performs an sheet process, though not shown in the drawings, the preceding sheet (P2) of the next sheet bundle is temporarily conveyed to the second conveying path, and stopped/held on standby on the second conveying path. If the subsequent sheet (P1) is conveyed from the reception and conveyance unit to the first conveying path, the preceding sheet (P2) is conveyed in an opposite direction to the introduction direction, superimposed on the subsequent sheet (P1) via the common conveying path, and then conveyed and discharged to the first sheet process unit (A) similarly to the above.

As can be seen, if the sheet process related to the first processing portion (A) is executed, the finisher path 552 serving as the first conveying path can be said to be a conveying path other than the specific conveying path for conveying the sheets devotedly to the specific processing portion among a plurality of sheet processing portions. In addition, the book binding path 553 serving as the second conveying path can be said to be not the conveying path other than the specific conveying path but the specific conveying path.

According to this first embodiment, if a sheet is conveyed to the specific processing portion that executes the sheet process among a plurality of sheet processing portions, the sheet is buffered using the conveying path other than the specific conveying path for conveying the sheet to the specific processing portion. The other conveying path is an existing conveying path and, quite naturally, longer than the sheets. It is, therefore, unnecessary to additionally provide a buffer path per se according to the sheet size.

Further, the buffered sheet is the first sheet conveyed from the image forming apparatus main body, and the non-buffered sheet is the second sheet.

The sheet processing apparatus includes the common conveying path for linking the conveying paths to each other so as to be able to convey the sheets therebetween. The image forming apparatus main body forms the image to be formed on the second sheet on the front or rear surface different from the rear or front surface of the first sheet on which the image is formed.

If the second sheet conveyed from the image forming apparatus main body is conveyed to the specific conveying path, the first sheet stopped on the other conveying path is conveyed in the opposite direction to the direction in which the first sheet is conveyed to the other conveying path. In addition, the first sheet is conveyed to the specific conveying path via the common conveying path, superimposed on the second sheet on the specific conveying path, and conveyed to the specific processing portion. As a result, when the first and second sheets are conveyed to the specific processing portion, the both sheets are superimposed while the front and rear surfaces of the first sheet coincide with those of the second sheet.

According to the first embodiment, therefore, the sheet processing apparatus does not need to have a complicated path configuration and the buffering can be performed using the existing path. It is, therefore, possible to suppress the device from being made large in size and to make the device compact. In addition, since the path configuration is not complicated, the reliability of the sheet process can be improved. Besides, it is possible to prevent the image formed surfaces from being made inconsistent or incorrect page order. In the first embodiment, the configuration of conveying the two sheets while superimposing them has been described. However, the sheets are not necessarily superimposed as long as it is possible to prevent the image formed surfaces from being made inconsistent or incorrect page order in the sheet processing portion. Namely, the first sheet held on standby may be wedged in front of the second sheet. In this case, it is necessary to adjust the transport interval from the image forming apparatus main body and to temporarily suspend the image formation.

Second Embodiment

A second embodiment of the present invention will be described. In the first embodiment, the image forming apparatus including a plurality of sheet processing portions has been described. However, even if one of the sheet processing portions is a stack unit including only the stacking function, the image forming apparatus can be configured similarly to the first embodiment.

Figure 26A:
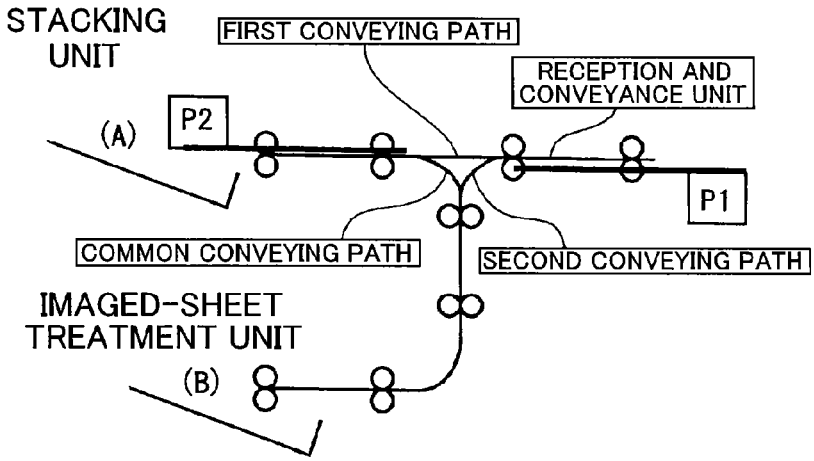
FIG. 26A is a conceptual view of another sheet process.
Figure 26B:
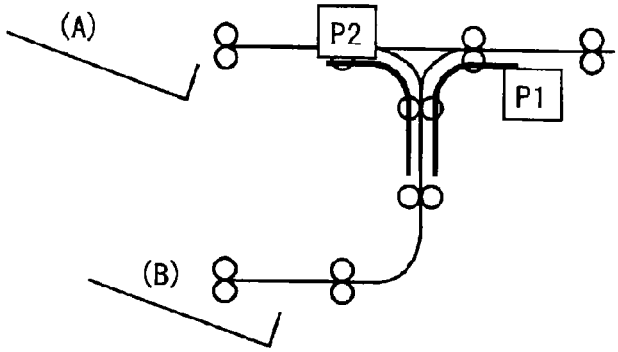
FIG. 26B is a conceptual view of another sheet process.
Figure 26C:
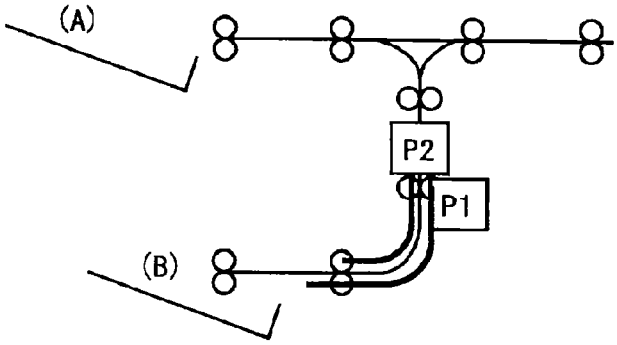
FIG. 26C is a conceptual view of another sheet process.

More specifically, as shown in FIGS. 26A, 26B, and 26C, the image forming apparatus according to the second embodiment is configured to include "a reception and conveyance unit", "a first conveying path", "a second conveying path", "a common conveying path", "a stacking unit (A)", and "a sheet processing portion (B)". If the sheet processing portion (B) performs the sheet process, the preceding sheet (P2) of the next sheet bundle is temporarily conveyed to the first conveying path, and stopped/held on standby on the first conveying path (refer to FIG. 26A).

If the subsequent sheet (P1) is conveyed from the reception and conveyance unit to the second conveying path, the preceding sheet (P2) is conveyed in the opposite direction to the introduction direction (refer to FIG. 26B) and superimposed on the subsequent sheet (P1) via the common conveying path. The both sheets thus superimposed are conveyed and discharged to the sheet processing portion (B) simultaneously (refer to FIG. 26C).

According to the second embodiment similarly to the first embodiment, therefore, the sheet processing apparatus does not need to have a complicated path configuration and the buffering can be performed using the existing path. It is, therefore, possible to suppress the device from being made large in size and to make the device compact. In addition, since the path configuration is not complicated, the reliability of the sheet process can be improved. Besides, it is possible to prevent the image formed surfaces from being made inconsistent or incorrect page order in the sheet processing portion.

The embodiments of the present invention have been specifically described so far. However, the present invention is not limited to the embodiments and various changes and modification can be made to the invention based on the technical concept of the invention.

This application claims priority from Japanese Patent Application No. 2004-212820 filed Jul. 21, 2004, Japanese Patent Application No. 2004-212821 filed July 21, and Japanese Patent Application No. 2005-183020filed Jun. 23, 2005, which is hereby incorporated by reference, herein.

What is claimed is:

1. A sheet processing apparatus comprising:

a first and a second sheet processing portions that perform a sheet process, respectively different from each other, on a sheet or a sheet bundle;

a first conveying path which conveys the sheet to the first sheet processing portion;

a second conveying path which conveys the sheet to the second sheet processing portion; and a linking path that links the first and the second conveying paths, wherein while the first sheet processing portion performs the sheet process on a preceding sheet or a preceding sheet bundle, a subsequent sheet is conveyed to the second conveying path and held on the second conveying path, and the subsequent sheet held on the second conveying path is conveyed to the first sheet processing portion via the linking path.

2. A sheet processing apparatus comprising:

a first and a second sheet processing portion that perform a sheet process, respectively different from each other, on a sheet or a sheet bundle;

a first conveying path which conveys the sheet to the first sheet processing portion;

a second conveying path which conveys the sheet to the second sheet processing portion; and a linking path that links the first and the second conveying paths, wherein while the first sheet processing portion performs the sheet process on a preceding sheet or a preceding sheet bundle, a subsequent sheet is conveyed to the second conveying path and held on the second conveying path, and the subsequent sheet held on the second conveying path is conveyed to the first sheet processing portion via the linking path, and when the subsequent sheet is conveyed to the first sheet processing portion via the linking path, the subsequent sheet is conveyed in an opposite direction to a direction in which the subsequent sheet is conveyed to the second sheet processing portion.

3. An image forming apparatus comprising:

an image forming apparatus main body which forms images on a sheet; and a sheet processing apparatus that performs a sheet process on the image formed sheet or an image formed sheet bundle, wherein the sheet processing apparatus comprises:

a first and a second processing portion that perform the sheet process, respectively different from each other, on a sheet or a sheet bundle;

a first conveying path which conveys the sheet to the first sheet processing portion;

a second conveying path which conveys the sheet to the second sheet processing portion; and a linking path that links the first and the second conveying paths, wherein while the first sheet processing portion performs the sheet process on a preceding sheet or a preceding sheet bundle, a subsequent sheet is conveyed to the second conveying path and held on the second conveying path, and the subsequent sheet held on the second conveying path is conveyed to the first sheet processing portion via the linking path.

4. An image forming apparatus comprising:

an image forming apparatus main body which forms images on a sheet; and a sheet processing apparatus that performs a sheet process on the image formed sheet or an image formed sheet bundle, wherein the sheet processing apparatus comprises:

a first and a second processing portion that perform the sheet process, respectively different from each other, on a sheet or a sheet bundle;

a first conveying path which conveys the sheet to the first sheet processing portion; and a second conveying path which conveys the sheet to the second sheet processing portion, wherein while the first sheet processing portion performs the sheet process on a preceding sheet or a preceding sheet bundle, a subsequent sheet is conveyed to the second conveying path and held on the second conveying path, and the subsequent sheet held on the second conveying path is conveyed to the first sheet processing portion, and an image formed surface of the subsequent sheet when being conveyed to the second conveying path is a front surface or a rear surface of the subsequent sheet, and an image formed surface of a sheet next to the subsequent sheet when being conveyed to the first conveying path is a rear surface or a front surface of the sheet next to the subsequent sheet, oppositely from the subsequent sheet.

5. An image forming apparatus comprising:

an image forming apparatus main body which forms images on a sheet; and a sheet processing apparatus that performs a sheet process on the image formed sheet or an image formed sheet bundle, wherein the sheet processing apparatus comprises:

a first and a second processing portion that perform the sheet process, respectively different from each other, on a sheet or a sheet bundle;

a first conveying path which conveys the sheet to the first sheet processing portion;

a second conveying path which conveys the sheet to the second sheet processing portion;

a mode in which a plurality of sheets are superimposed on one another on the first conveying path, and conveyed to the first sheet processing portion; and a mode in which the plurality of sheets are conveyed to the first sheet processing portion one by one, wherein while the first sheet processing portion performs the sheet process on a preceding sheet or a preceding sheet bundle, a subsequent sheet is conveyed to the second conveying path and held on the second conveying path, and the subsequent sheet held on the second conveying path is conveyed to the first sheet processing portion.

6. An image forming apparatus comprising:

an image forming apparatus main body which forms images on a sheet;

a first and a second sheet processing portions that perform a sheet process, respectively different from each other, on the image formed sheet or an image formed sheet bundle;

a first conveying path which conveys the sheet to the first sheet processing portion;

a second conveying path which conveys the sheet to the second sheet processing portion;

a controller which controls such that, while the first sheet processing portion performs the sheet process on a preceding sheet or a preceding sheet bundle, a subsequent sheet is conveyed to the second conveying path and held on the second conveying path, and the subsequent sheet held on the second conveying path is conveyed to the first sheet processing portion; and a linking path that links the first and the second conveying paths, wherein the controller controls at least one of an imaging order, an imaging position, and an inverted conveying with respect to the subsequent sheet and a next sheet to the subsequent sheet, and controls such that subsequent sheet held on the second conveying path is conveyed to the first sheet processing portion via the linking path.

7. An image forming apparatus comprising:

an image forming apparatus main body which forms images on a sheet;

a first and a second sheet processing portion that perform a sheet process, respectively different from each other, on the image formed sheet or an image formed sheet bundle;

a first conveying path which conveys the sheet to the first sheet processing portion;

a second conveying path which conveys the sheet to the second sheet processing portion;

a controller which controls such that, while the first sheet processing portion performs the sheet process on a preceding sheet or a preceding sheet bundle, a subsequent sheet is conveyed to the second conveying path and held on the second conveying path, and the subsequent sheet held on the second conveying path is conveyed to the first sheet processing portion; and a linking path that links the first and the second conveying paths, wherein the controller controls at least one of an imaging order, an imaging position, and an inverted conveying with respect to the subsequent sheet and a next sheet to the subsequent sheet, and controls such that, when a sheet next to the subsequent sheet is conveyed to the first conveying path after the subsequent sheet is conveyed to the second conveying path and stopped on the second conveying path, the subsequent sheet is conveyed to the first conveying path via the linking path.

8. An image forming apparatus comprising:

an image forming apparatus main body which forms images on a sheet;

a first and a second sheet processing portion that perform a sheet process, respectively different from each other, on the image formed sheet or an image formed sheet bundle;

a first conveying path which conveys the sheet to the first sheet processing portion;

a second conveying path which conveys the sheet to the second sheet processing portion; and a controller which controls such that, while the first sheet processing portion performs the sheet process on a preceding sheet or a preceding sheet bundle, a subsequent sheet is conveyed to the second conveying path and held on the second conveying path, and the subsequent sheet held on the second conveying path is conveyed to the first sheet processing portion, wherein the controller controls at least one of an imaging order, an imaging position, and an inverted conveying with respect to the subsequent sheet and a next sheet to the subsequent sheet, and controls such that an image formed surface of the subsequent sheet is a front surface or a rear surface of the subsequent sheet, and such that an image formed surface of the sheet next to the subsequent sheet is a rear surface or a front surface of the sheet next to the subsequent sheet, oppositely from the subsequent sheet.

9. An image forming apparatus comprising:

an image forming apparatus main body which forms images on a sheet;

a first and a second sheet processing portion that perform a sheet process, respectively different from each other, on the image formed sheet or an image formed sheet bundle;

a first conveying path which conveys the sheet to the first sheet processing portion;

a second conveying path which conveys the sheet to the second sheet processing portion; and a controller which controls such that, while the first sheet processing portion performs the sheet process on a preceding sheet or a preceding sheet bundle, a subsequent sheet is conveyed to the second conveying path and held on the second conveying path, and the subsequent sheet held on the second conveying path is conveyed to the first sheet processing portion, wherein the controller controls at least one of an imaging order, an imaging position, and an inverted conveying with respect to the subsequent sheet and a next sheet to the subsequent sheet, and controls such that an image is formed on the front surface of the subsequent sheet, and such that an image is formed on the rear surface of the sheet next to the subsequent sheet.

10. An image forming apparatus comprising:

an image forming apparatus main body which forms images on a sheet;

a first and a second sheet processing portion that perform a sheet process, respectively different from each other, on the image formed sheet or an image formed sheet bundle;

a first conveying path which conveys the sheet to the first sheet processing portion;

a second conveying path which conveys the sheet to the second sheet processing portion; and a controller which controls such that, while the first sheet processing portion performs the sheet process on a preceding sheet or a preceding sheet bundle, a subsequent sheet is conveyed to the second conveying path and held on the second conveying path, and the subsequent sheet held on the second conveying path is conveyed to the first sheet processing portion, wherein the controller controls at least one of an imaging order, an imaging position, and an inverted conveying with respect to the subsequent sheet and a next sheet to the subsequent sheet, and controls such that a direction of the subsequent sheet when being conveyed to the first sheet processing portion is a direction of a leading end or a trailing end of an image formed on the subsequent sheet, and such that a direction of the sheet next to the subsequent sheet when being conveyed to the first sheet processing portion is the direction of a trailing end or a leading end of an image formed on the sheet next to the subsequent sheet, oppositely from the subsequent sheet.

11. An image forming apparatus comprising:

an image forming apparatus main body which forms images on a sheet;

a first and second sheet processing portion that perform a sheet process, respectively different from each other, on the image formed sheet or an image formed sheet bundle;

a first conveying path which conveys the sheet to the first sheet processing portion;

a second conveying path which conveys the sheet to the second sheet processing portion; and a controller which controls such that, while the first sheet processing portion performs the sheet process on a preceding sheet or a preceding sheet bundle, a subsequent sheet is conveyed to the second conveying path and held on the second conveying path, and the subsequent sheet held on the second conveying path is conveyed to the first sheet processing, wherein the controller controls at least one of an imaging order, an imaging position, and an inverted conveying with respect to the subsequent sheet and a next sheet to the subsequent sheet, and controls an imaging page order of the subsequent sheet when being conveyed to the first sheet processing portion to be opposite to an imaging page order of the sheet next to the subsequent sheet when being conveyed to the first sheet processing portion.

12. An image forming apparatus comprising;

an image forming apparatus main body which forms images on a sheet;

a first and a second sheet processing portion that perform a sheet process, respectively different from each other, on the image formed sheet or an image formed sheet bundle;

a first conveying path which conveys the sheet to the first sheet processing portion;

a second conveying path which conveys the sheet to the second sheet processing portion;

a controller which controls such that, while the first sheet processing portion performs the sheet process on a preceding sheet or a preceding sheet bundle, a subsequent sheet is conveyed to the second conveying path and held on the second conveying path, and the subsequent sheet held on the second conveying path is conveyed to the first sheet processing portion; and a linking path that links the first and the second conveying paths, wherein the controller controls at least one of an imaging order, an imaging position, and an inverted conveying with respect to the subsequent sheet and a next sheet to the subsequent sheet, and controls such that, when a sheet next to the subsequent sheet is conveyed to the first conveying path after the subsequent sheet is conveyed to the second conveying path and stopped on the second conveying path, the subsequent sheet is conveyed to the first conveying path via the linking path, and controls such that, when the subsequent sheet is conveyed to the first conveying path via the linking path, the subsequent sheet is conveyed in an opposite direction to a direction in which the subsequent sheet is conveyed to the second conveying path.

13. An image forming apparatus comprising:

an image forming apparatus main body which forms images on a sheet;

a first and a second sheet processing portion that perform a sheet process, respectively different from each other, on the image formed sheet or an image formed sheet bundle;

a first conveying path which conveys the sheet to the first sheet processing portion;

a second conveying path which conveys the sheet to the second sheet processing portion;

a controller which controls such that, while the first sheet processing portion performs the sheet process on a preceding sheet or a preceding sheet bundle, a subsequent sheet is conveyed to the second conveying path and held on the second conveying path, and the subsequent sheet held on the second conveying path is conveyed to the first sheet processing portion;

a mode in which a plurality of sheet are superimposed on one another on the first conveying path, and conveyed to the first sheet processing portion; and a mode in which the plurality of sheets are conveyed to the first sheet processing portion one by one, wherein the controller controls at least one of an imaging order, an imaging position, and an inverted conveying with respect to the subsequent sheet and a next sheet to the subsequent sheet, and the controller makes an order of imaging the plurality of sheets differ according to the respective modes.

* * * * *